US007513845B2

(12) United States Patent
Ho

(10) Patent No.: US 7,513,845 B2
(45) Date of Patent: Apr. 7, 2009

(54) VARIABLE SPEED TRANSMISSION FOR A POWER TOOL

(75) Inventor: Chi Hong Ho, Hong Kong (CN)

(73) Assignee: Eastway Fair Company Limited (VG)

( * ) Notice: Subject to any disclaimer, the term of this patent is extended or adjusted under 35 U.S.C. 154(b) by 429 days.

(21) Appl. No.: 11/497,621

(22) Filed: Aug. 1, 2006

(65) Prior Publication Data

US 2008/0032848 A1 Feb. 7, 2008

(51) Int. Cl.

| | |
|---|---|
| ***F16H 3/44*** | (2006.01) |
| ***E21B 3/00*** | (2006.01) |
| ***E21B 17/22*** | (2006.01) |
| ***E21B 19/16*** | (2006.01) |
| ***E21B 19/18*** | (2006.01) |

(52) U.S. Cl. ..... 475/298; 173/216

(58) Field of Classification Search ..... 475/298; 173/216

See application file for complete search history.

(56) References Cited

U.S. PATENT DOCUMENTS

| | | | | |
|---|---|---|---|---|
| 3,257,877 | A | 6/1966 | Ulrich et al. | |
| 3,430,521 | A | 3/1969 | Kulman | |
| 4,215,594 | A | 8/1980 | Workman, Jr. et al. | |
| 4,641,551 | A | 2/1987 | Pascaloff | |
| 4,650,007 | A | 3/1987 | Fujita et al. | |
| 4,834,192 | A | 5/1989 | Hansson | |
| 4,869,131 | A | 9/1989 | Ohmori | |
| 4,869,139 | A | 9/1989 | Gotman | |
| 4,892,013 | A | 1/1990 | Satoh | |
| 4,898,249 | A | 2/1990 | Ohmori | |
| 4,953,774 | A | 9/1990 | Lai | |
| 5,019,023 | A | 5/1991 | Kurosawa | |
| 5,083,990 | A | 1/1992 | Rahm | |
| 5,399,129 | A | 3/1995 | Ciolli | |
| 5,573,472 | A | 11/1996 | Ciolli | |
| 5,711,739 | A | 1/1998 | Hashimoto et al. | |
| 5,897,454 | A | 4/1999 | Cannaliato | |
| 5,967,934 | A | 10/1999 | Ishida et al. | |
| 6,165,096 | A | 12/2000 | Seith | |
| 6,273,200 | B1 * | 8/2001 | Smith et al. | 173/216 |
| 6,655,470 | B1 | 12/2003 | Chen | |
| 6,676,557 | B2 | 1/2004 | Milbourne et al. | |
| 6,796,921 | B1 | 9/2004 | Buck et al. | |
| 6,824,491 | B2 | 11/2004 | Chen | |
| 6,857,983 | B2 | 2/2005 | Milbourne et al. | |
| 6,892,611 | B2 | 5/2005 | Sasaki | |
| 7,452,304 | B2 * | 11/2008 | Hagan et al. | 475/298 |
| 2002/0148623 | A1 | 10/2002 | Pan | |

FOREIGN PATENT DOCUMENTS

| | | |
|---|---|---|
| DE | 195 31 043 A1 | 2/1996 |
| EP | 0 281 775 A2 | 9/1988 |

(Continued)

*Primary Examiner*—Tisha D Lewis
(74) *Attorney, Agent, or Firm*—Michael Best & Friedrich LLP

(57) ABSTRACT

A variable speed transmission that changes the output speed of a power tool in response to an increase in torque. The transmission includes a first transmission portion, a second transmission portion, and an annular connector. The annular connector may move via a spring and a control mechanism between a first position and a second position to vary the power tool output between a first and a second speed.

20 Claims, 22 Drawing Sheets

FOREIGN PATENT DOCUMENTS

| | | | |
|---|---|---|---|
| EP | 0 302 229 | A2 | 2/1989 |
| EP | 0 302 244 | A2 | 2/1989 |
| EP | 0 787 931 | B1 | 8/1997 |
| EP | 1 092 896 | A1 | 5/2001 |
| GB | 2 193 767 | A | 2/1988 |
| JP | 64-34678 | | 2/1989 |
| JP | 6-202506 | | 7/1994 |
| JP | 7-100844 | | 4/1995 |
| JP | 8-68446 | | 3/1996 |
| JP | 8-296706 | | 11/1996 |
| WO | WO 87/03523 | | 6/1987 |

* cited by examiner

VARIABLE SPEED TRANSMISSION FOR A POWER TOOL

BACKGROUND OF THE INVENTION

This invention relates to power tools. More particularly, this invention relates to a variable speed transmission for use with a power tool.

Tasks typically performed by a power tool, such as drilling and screw driving, generally require a low torque at the initial stage of the task and a higher torque at the final stage of the task. It would therefore be desirable to have a transmission capable of varying the speed and torque output of the power tool as the performed task transitions from the initial to the final stage. Such variable speed transmission would increase the efficiency of the power tool and would also protect the motor from overload and burnout.

SUMMARY

This invention provides a variable speed transmission for use with a power tool. The transmission automatically switches from a first transmission output to a second transmission output in response to an input torque. The transmission therefore provides a high speed, low torque output at the initial stage of the power tool task and a low speed, high torque output at the final stage of the power tool task.

In one example, the transmission includes a first transmission portion having a first ring gear that is operable to receive an input torque and a second transmission portion that is coupled to the first transmission portion and having a second ring gear. An annular connector is coupled to the second ring gear and is axially movable between a first position and a second position. A spring is coupled to the annular connector and biases the annular connector to the second position. A control mechanism engages the spring. The first transmission output is produced when the input torque is less than a predetermined force and the annular connector is in the first position. The second transmission output is produced when the input torque exceeds the predetermined force and the annular connector is in the second position.

In another example, the transmission includes a first transmission portion having a first ring gear that is operable to receive an input torque and a second transmission portion that is coupled to the first transmission portion and having a second ring gear. An annular connector is coupled to the second ring gear and is axially movable between a first position and a second position. A spring is coupled to the annular connector and a control mechanism engages the spring. A trigger switch is operable to selectively power a motor via a motor switch. The first transmission output is produced when the trigger switch is actuated and the control mechanism compresses the spring to move the annular connector to the first position. The second transmission output is produced when the input torque received by the first ring gear exceeds a predetermined force and the control mechanism releases the spring to move the annular connector to the second position.

In another example, the transmission includes a first transmission portion that is operable to receive an input torque and has a first carrier and a second transmission portion that is coupled to the first transmission portion. An annular connector is movable between a first position when the received input torque is less than a predetermined force and a second position when the received input torque is greater than the predetermined force. The first transmission output is produced when the annular connector is in the first position and the first carrier and the second transmission portion rotate together. The second transmission output is produced when the annular connector is in the second position and the first transmission portion and the second transmission portion rotate independently.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Figure 1:
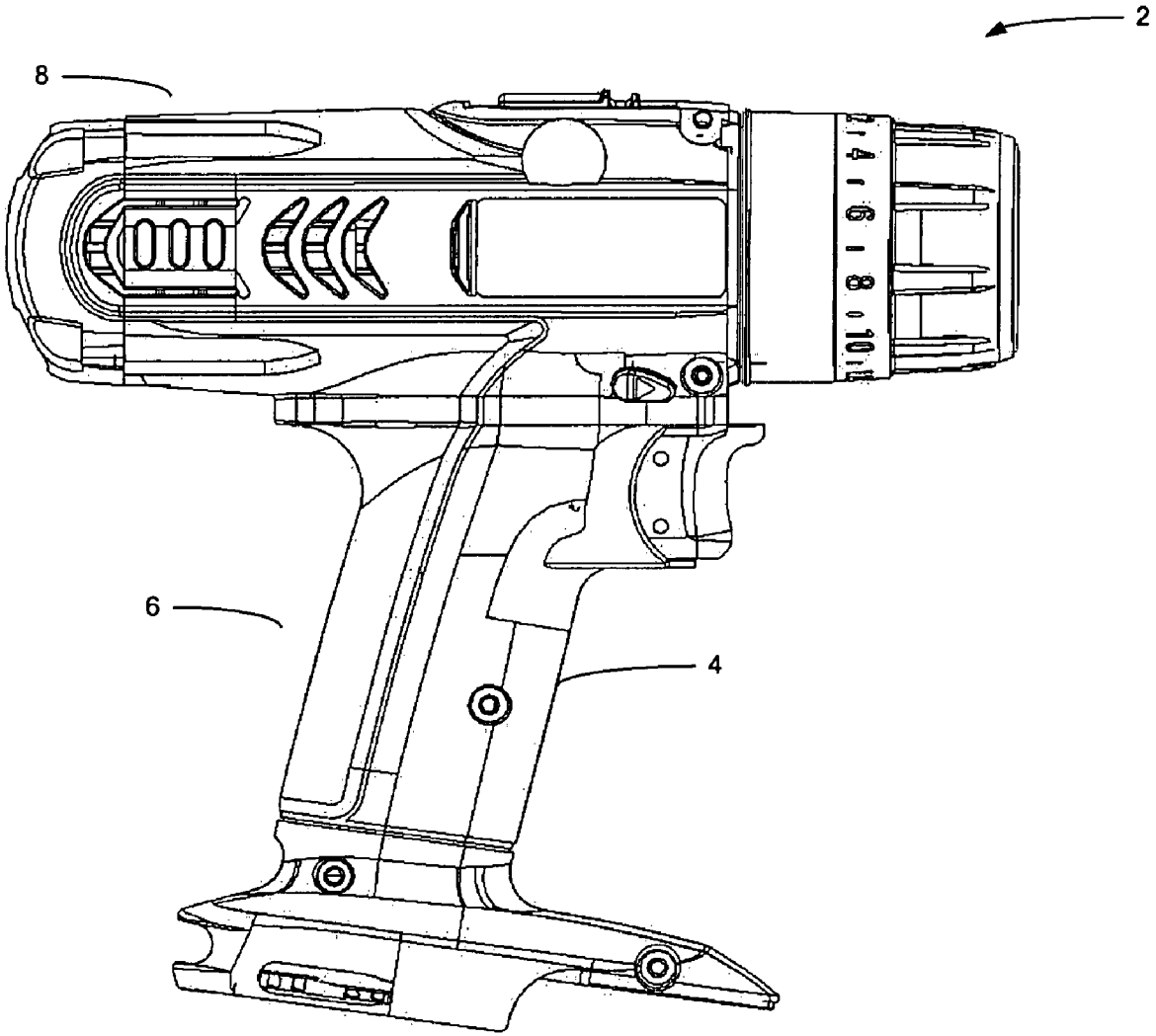
FIG. 1 is an illustration of an exemplary power tool containing a variable speed transmission.
Figure 2:
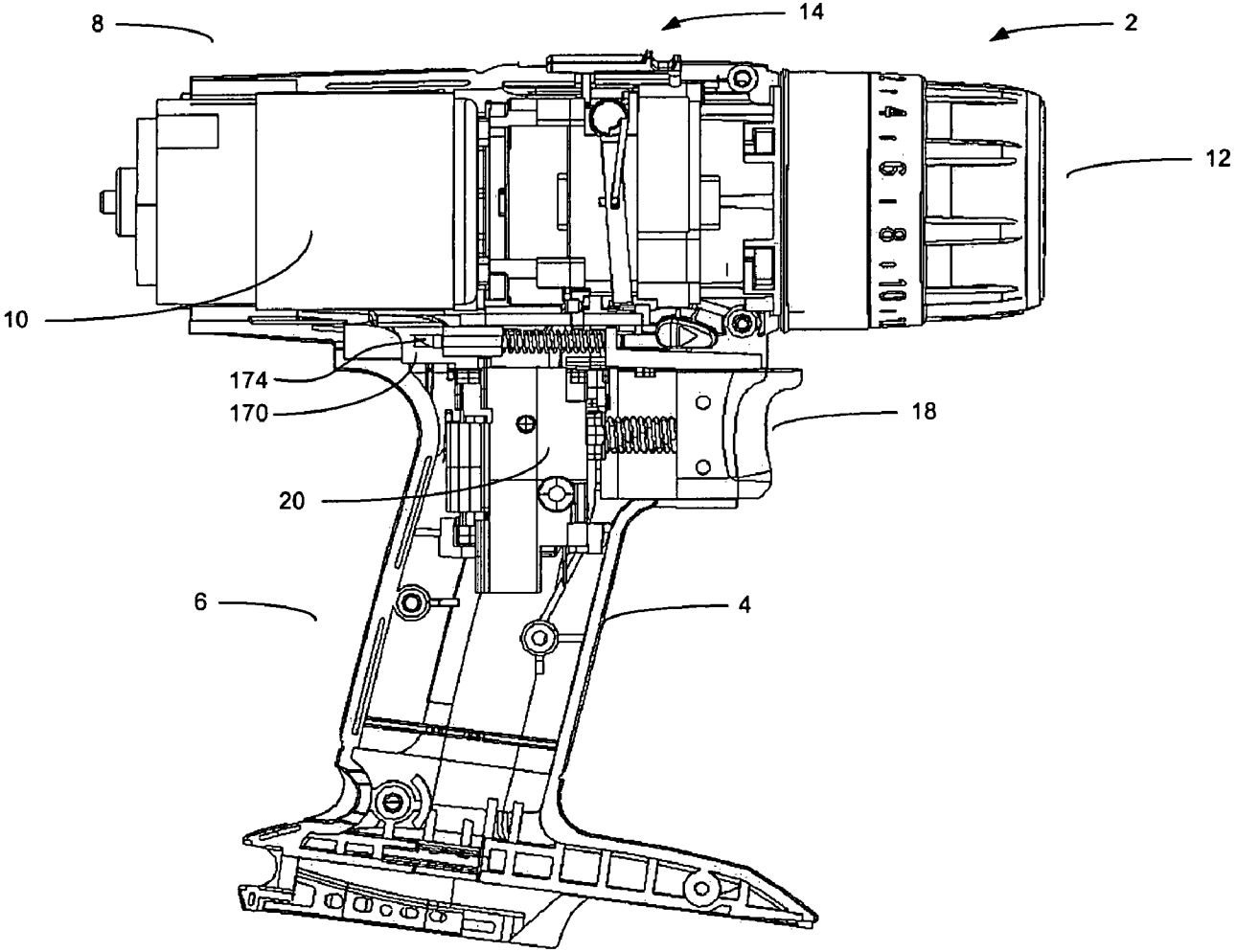
FIG. 2 is an illustration of an exemplary power tool containing a variable speed transmission with portions removed to better illustrate features of the invention.

An example of a power tool 2 that may incorporate a variable speed transmission is shown in FIG. 1. The power tool 2 may be powered from an external power source via a power chord or may be battery powered. The power tool 2 may include a power tool housing 4 that may receive the power cord or the battery pack. The power tool housing 4 may have a handle portion 6 and a drive portion 8. As shown in FIG. 2, the drive portion 8 may include a motor 10, an output 12, and a drive train 14 located intermediate the motor 10 and the output 12. The drive train 14 may include a variable speed transmission 16 to mechanically change the speed of the output 12. The power tool 2 may also include a trigger switch 18 and a motor switch 20 for selectively activating the motor 10 to supply power to the drive train 14.

Figure 3:
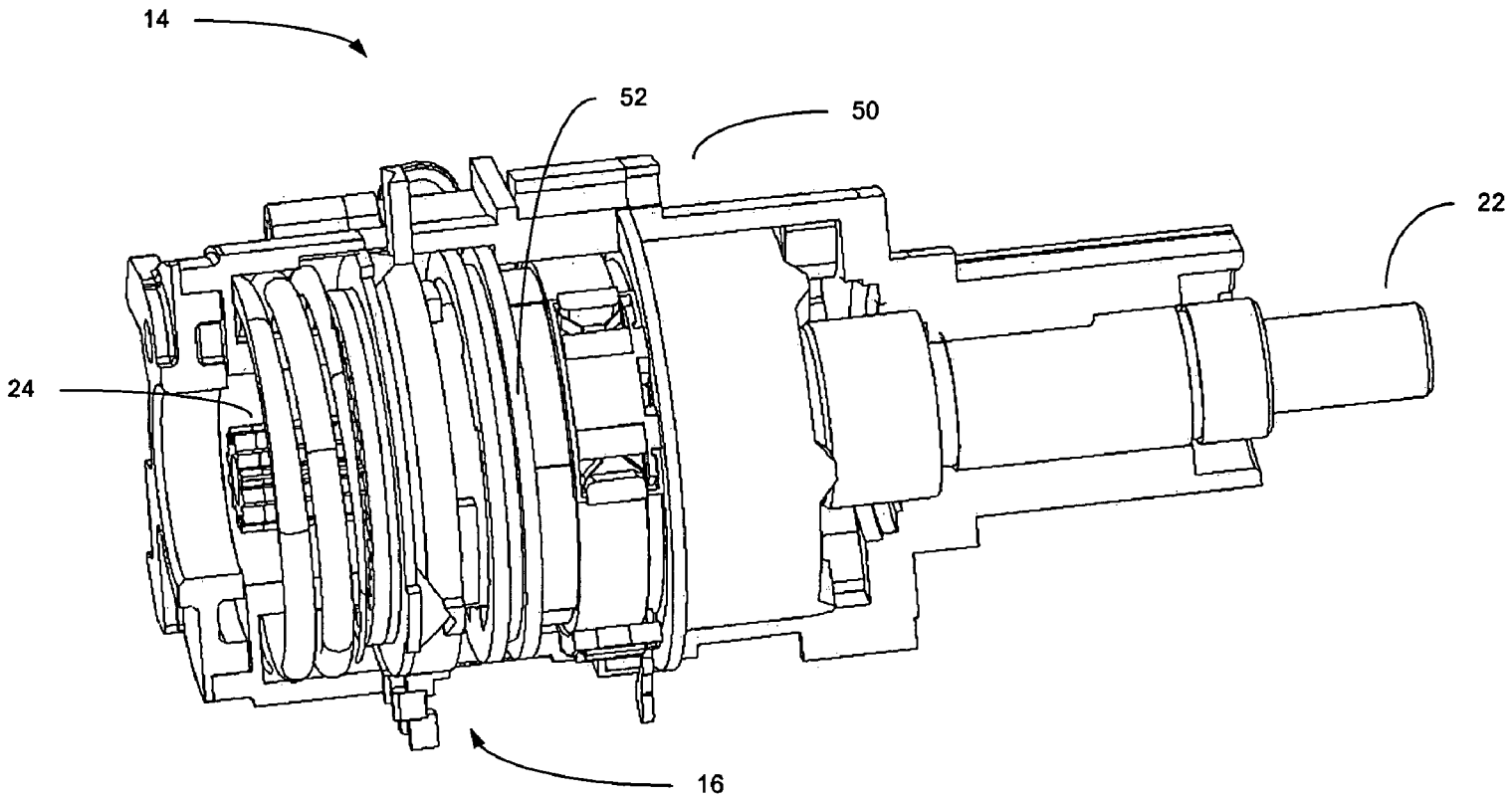
FIG. 3 is an illustration of an exemplary drive train with portions removed to better illustrate features of the invention.

An example of the drive train 14 is shown in FIG. 3. The drive train 14 includes an output spindle 22 and an input pinion 24. The output spindle 22 may be coupled to the output 12 of the power tool 2. The input pinion 24 may be coupled to the motor 10. The motor 10 may drive the input pinion 24 to rotate when the trigger switch 18 is actuated. The rotational energy from the motor 10 may be transferred from the input pinion 24 through the drive train 14 to the output spindle 22. The drive train 14 includes a variable speed transmission 16 to change the speed of rotation from the input pinion 24 to the output spindle 22 in response to a predetermined input torque.

Figure 4:
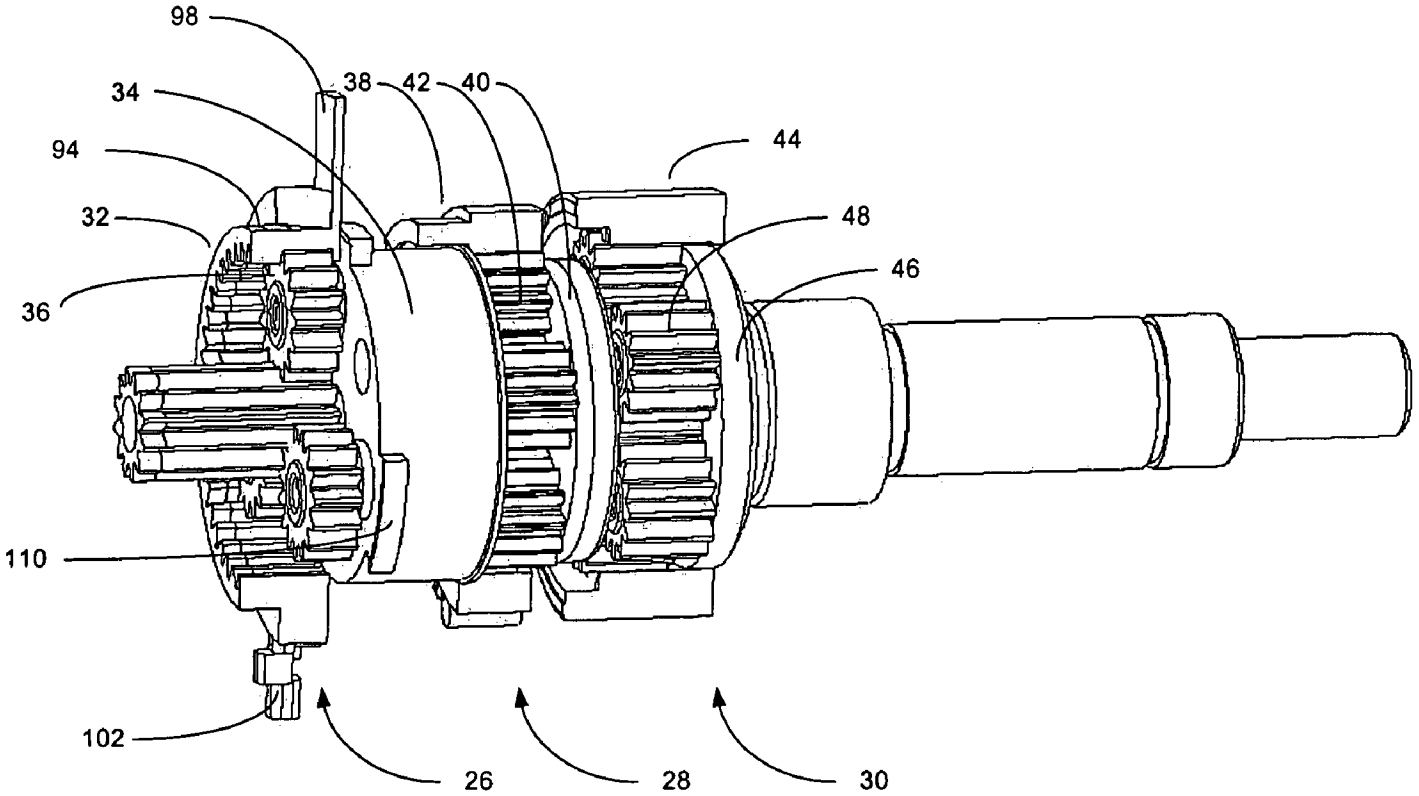
FIG. 4 is an illustration of the transmission gearing with portions removed to better illustrate features of the invention.

An example of the variable speed transmission 16 is shown in FIG. 4. The transmission 16 may include a first transmission portion 26, a second transmission portion 28, and a third transmission portion 30. The first transmission portion 26 has a first ring gear 32, a first carrier 34, and first planetary gears 36. The second transmission portion 28 has a second ring gear 38, a second carrier 40, and second planetary gears 42. The third transmission portion 30 has a third ring gear 44, a third carrier 46, and third planetary gears 48. The transmission 16 may also include a transmission housing 50 and a connector 52 that axially moves within the transmission housing 50 to change speeds of the output spindle 22 (see FIG. 3).

Figure 5:
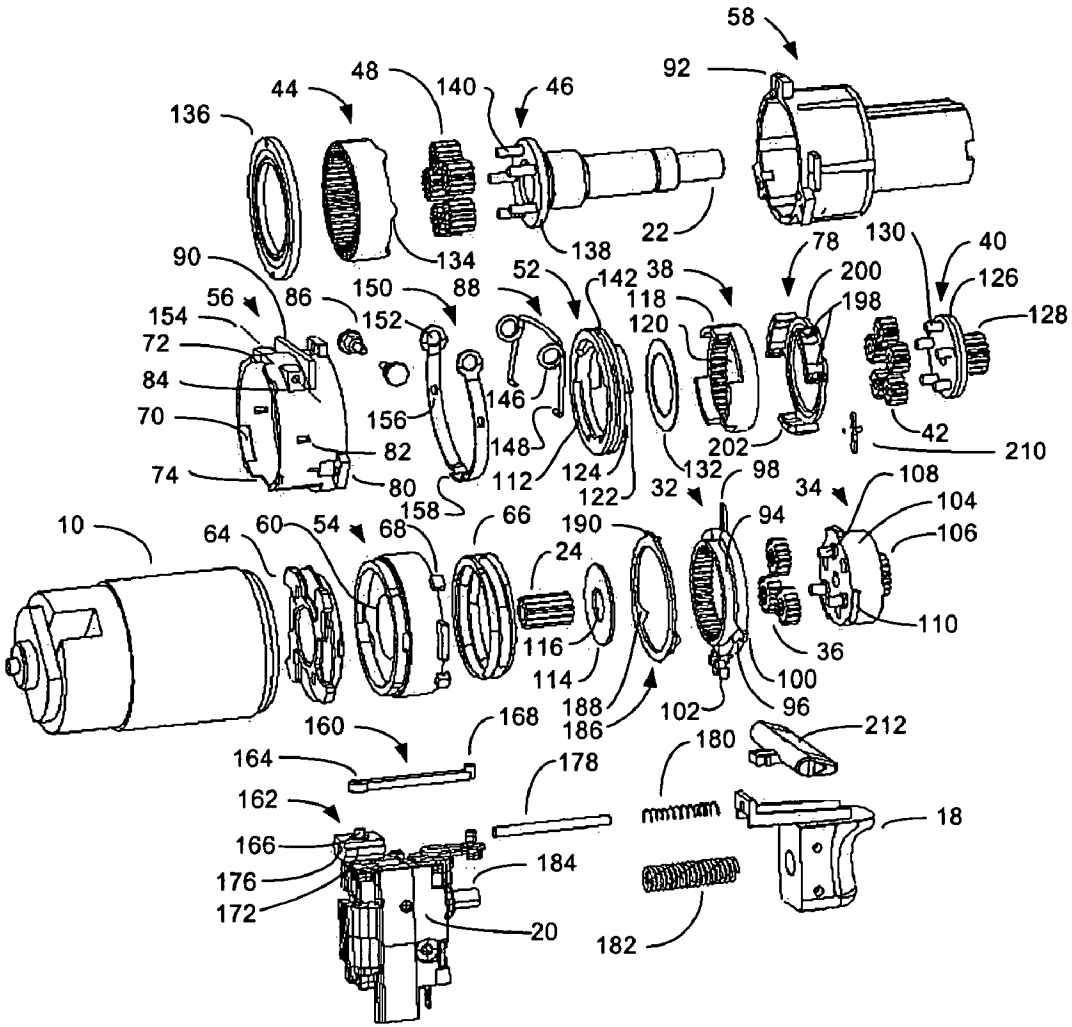
FIG. 5 is an exploded view of the transmission.
Figure 6:
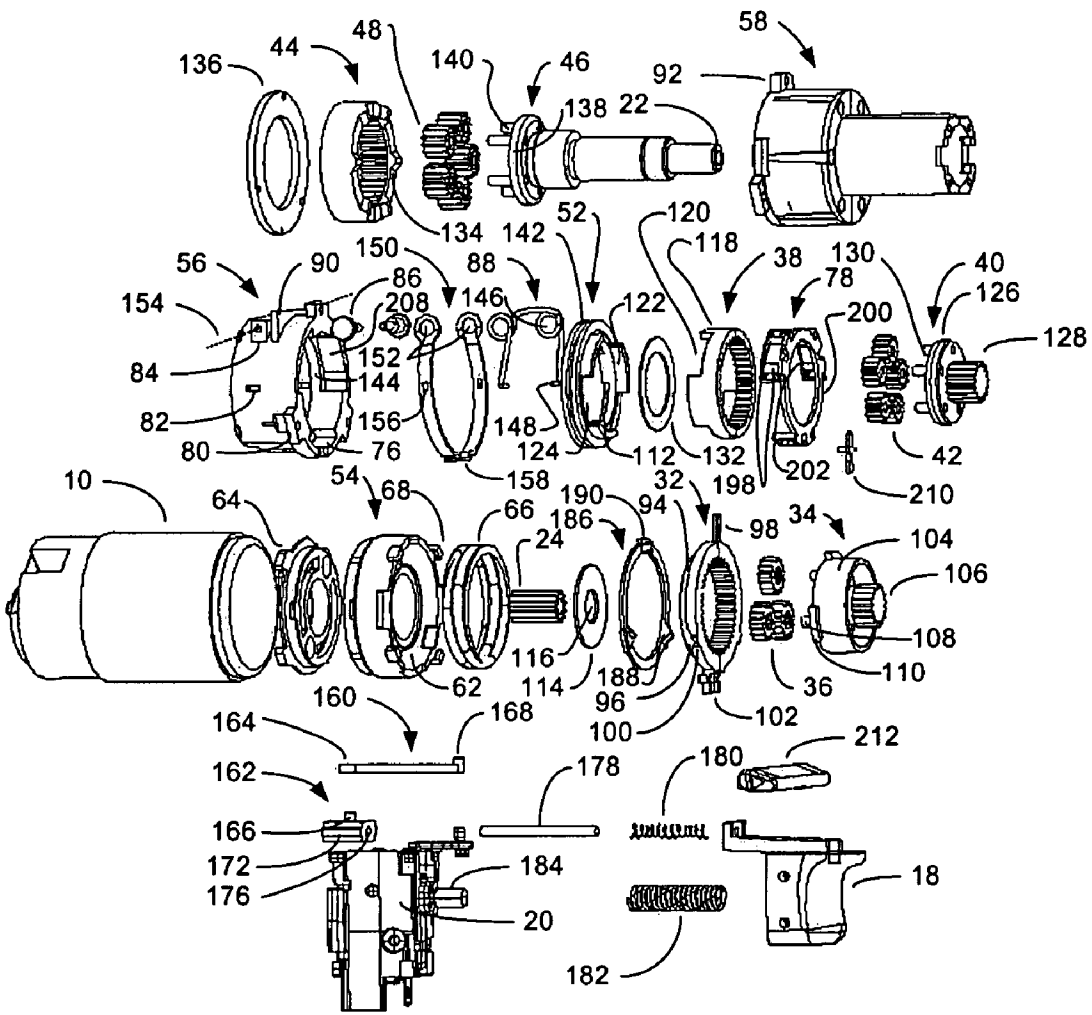
FIG. 6 is an exploded view of the transmission.

An example of the transmission housing 50 can be seen in FIGS. 5 and 6. In the example, the transmission housing 50 has a first housing portion 54, a second housing portion 56, and a third housing portion 58, although the transmission housing 50 may have any combination of housing portions including a single housing. The second housing portion 56 is coupled between the first housing portion 54 and the third housing portion 58. The first housing portion 54 is annular shaped and may form a first chamber 60 at one end and a second chamber 62 at an opposite end. The first chamber 60 may be coupled to a motor mount 64. The motor mount 64 may be coupled to the motor 10 to secure the motor 10 to the drive train 14.

The second chamber 62 may be coupled to a torque spring 66 and may provide an axial backstop to the torque spring 66. The input pinion 24, coupled at one end to the motor 10, may extend through the motor mount 64, the first housing portion 54, and the torque spring 66 and may be coupled at a second end to the first transmission portion 26. The first housing portion 54 may also have one or more clamps 68 for coupling the first housing portion 54 to the second housing portion 56, although other known coupling methods such as screws, adhesive, or press-fitting may be used. The clamps 68 may allow for quick disassembly of the first and second housing portions 54, 56 to allow the torque spring 66 to be replaced or exchanged.

The second housing portion 56 is annular shaped and may have one or more notches 70 formed within the inner circumferential surface. The notches 70 may have an arc length extending circumferentially within the inner surface. The second housing portion 56 may also have a first gap 72 and a second gap 74 formed within the exterior surface. The gaps 72, 74 may have an arc length extending circumferentially along the exterior surface. The second housing portion 56 may also have one or more grooves 76 formed within the inner circumferential surface that may be used in association with a one-way clutch 78 (discussed below). The second housing portion 56 may also have one or more first fittings 80 located on the exterior surface. The first fittings 80 may receive a screw or other coupling mechanism to couple the second housing portion 56 to the third housing portion 58, although other known coupling methods such as clamping, adhesive, or press-fitting may be used.

The second housing portion 56 may have one or more apertures 82 formed through the exterior surface. The apertures 82 may be slot-like with the slot extending parallel to the axis of rotation of the drive train 14. The second housing portion 56 may also have one or more second fittings 84 located on the exterior surface. The second fittings 84 may receive one or more screws 86 or other coupling mechanism to couple the second housing portion 56 to a spring 88. The second housing portion 56 may also have a protrusion 90 extending from the exterior surface to axially support the spring 88.

The third housing portion 58 is annular shaped and may have one or more fittings 92 corresponding to the first fittings 80 on the second housing portion 56. The fittings 80, 92 act to couple the second and third housing portions 56, 58 together via a coupling mechanism. The output spindle 22 may extend through the third housing portion 58.

Turning back to FIG. 4, the first ring gear 32 is an annular member that has teeth on the inner circumferential surface that mesh with the first planetary gears 36. The outer circumferential surface of the first ring gear 32 may form a ledge 94. The first ring gear 32 may also have one or more cam surfaces 96 formed on the external surface (see for example FIG. 12). The cam surfaces 96 may, in one example form a V-shape and, in another example, form a curved shape.

The first ring gear 32 may have a tab 98 extending from the outer circumferential surface. The tab 98 may extend through the first gap 72 of the second housing portion 56. The tab 98 may limit the rotation of the first ring gear 32 to the arc length of the first gap 72. The tab 98 may also provide axial support to the first ring gear 32. The tab 98 may also act as an indicator to the amount of torque received by the transmission 16 during operation of the power tool 2. As discussed below, the first ring gear 32 may rotate in response to a received input torque. The tab 98 may therefore indicate the amount of torque received on the first ring gear 32. In this regard, the tab 98 may also indicate when the transmission 16 may change speeds in response to the received input torque.

The first ring gear 32 may also have one or more protrusions 100 extending from the outer circumferential surface. The protrusions 100 may engage the notches 70 of the second housing portion 56. The protrusions 100 may limit the rotation of the first ring gear 32 to the arc length of the notches 70. The protrusions 100 may also prevent the first ring gear 32 from axial movement within the transmission housing 50. The first ring gear 32 may also have one or more guides 102 extending from the outer circumferential surface. The guides 102 may extend through the second gap 74 of the second housing portion 56. The guides 102 may also limit the rotation of the first ring gear 32 to the arc length of the second gap 74. The guides 102 may also provide axial support to the first ring gear 32. In one example, the arc lengths of the first gap 72, the notches 70, and the second gap 74 are equal such that the tab 98, protrusions 100, and guides 102 cooperate to limit the rotation of the first ring gear 32 an equal amount.

The first carrier 34 includes a disc shaped body 104, a sun gear 106, and one or more retaining members 108. The retaining members 108 and sun gear 106 are on opposite sides of the disc body 104. The sun gear 106 has teeth that mesh with the second planetary gears 42. The retaining members 108 act as axles for the first planetary gears 36. The first carrier 34 may also have one or more protrusions 110 extending from the outer circumferential surface of the disc body 104. The protrusions 110 may engage one or more slots 112 located on the inner circumferential surface of the connector 52 to lock the first carrier 34 with the connector 52 when the connector 52 is in a first position.

The first planetary gears 36 have teeth that mesh with the teeth of the first ring gear 32. The first planetary gears 36 also mesh with teeth on the input pinion 24. Thus, when the motor 10 is activated, the rotational energy is transferred from the input pinion 24 to the first planetary gears 36 and thereon through the rest of the drive train 14. A washer 114 may be coupled to the first planetary gears 36 opposite the side of the first carrier 34 to restrain the first planetary gears 36 from axial movement. The washer 114 may be coupled between the second chamber 62 of the first housing portion 54 and the first planetary gears 36. The washer 114 may also have a bore 116 to allow the input pinion 24 to pass through the washer 114.

The second ring gear 38 is an annular member that has teeth on the inner circumferential surface that mesh with the second planetary gears 42. The outer circumferential surface is circular to enable to the second ring gear 38 to freely rotate within the transmission housing 50. The second ring gear 38, however, may be axially fixed within the transmission housing 50. The second ring gear 38 is coupled to the connector 52. The second ring gear 38 may be coupled to the connector 52 such that the second ring gear 38 and the connector 52 rotate together. In one example, as shown in FIGS. 5 and 6, the second ring gear 38 may have one or more protrusions 118 alternately spaced to define one or more recesses 120. The protrusions 118 and recesses 120 may be located circumferentially around the second ring gear 38. The protrusions 118 and recesses 120 may engage corresponding protrusions 122 and recesses 124 on the connector 52 to lock the second ring gear 38 with the connector 52.

The second carrier 40 includes a disc shaped body 126, a sun gear 128, and one or more retaining members 130. The retaining members 130 and sun gear 128 are on opposite sides of the disc body 126. The sun gear 128 has teeth that mesh with the third planetary gears 48. The retaining members 130 act as axles for the second planetary gears 42. The second planetary gears 42 have teeth that mesh with the teeth of the second ring gear 38. The second planetary gears 42 also mesh with teeth on the sun gear 128 of the first carrier 34. A washer 132 may be coupled to the second planetary gears 42 opposite the side of the second carrier 40 to restrain the second planetary gears 42 from axial movement. The washer 132 may be coupled between the disc body 126 of the first carrier 34 and the second planetary gears 42.

The third ring gear 44 is an annular member that has teeth on the inner circumferential surface that mesh with the third planetary gears 48. The outer circumferential surface is circular to enable the third ring gear 44 to freely rotate within the transmission housing 50. The exterior surface of the third ring gear 44 may have one or more axially extending cam members 134 that may engage a conventional clutch (not shown) to provide the desired torque output. A spacer 136 may be coupled to the third ring gear 44 to axially support the third ring gear 44. The spacer 136 may be coupled between the second housing portion 56 and the third housing portion 58.

The third carrier 46 includes a disc shaped body 138, a sun gear (not shown), and one or more retaining members 140. The retaining members 140 and sun gear are on opposite sides of the disc body 138. The sun gear may, in one example, be coupled to the output spindle 22. In another example, the sun gear may be monolithic with the output spindle 22. The retaining members 140 act as axles for the third planetary gears 48. The third planetary gears 48 have teeth that mesh with the teeth of the third ring gear 44. The third planetary gears 48 also mesh with teeth on the sun gear 128 of the second carrier 40. In one example, the spacer 136 is coupled to the third planetary gears 48 opposite the side of the third carrier 46 to restrain the third planetary gears 48 from axial movement. In another example, a washer (not shown) is coupled to the third planetary gears 48 opposite the side of the third carrier 46 to restrain the third planetary gears 48 from axial movement. The washer may be coupled between the disc body 126 of the second carrier 40 and the third planetary gears 48.

The connector 52 is an annular member that has a circular outer surface to enable the connector 52 to freely rotate within the transmission housing 50. The connector 52 may have a circumferential groove 142 to couple the connector 52 with the spring 88. The connector 52 may have one or more protrusions 122 alternately spaced with one or more recesses 124. The protrusions 122 and recesses 124 may be located circumferentially around the connector 52. The protrusions 122 and recesses 124 may engage the corresponding protrusions 118 and recesses 120 on the second ring gear 38. The protrusions and recesses may remain engaged as the connector 52 moves within the housing.

The connector 52 is axially moveable within the transmission housing 50. The connector 52 may be moveable between a first position and a second position. In the first position, the connector 52 may be locked with the first carrier 34. The inner circumferential surface of the connector 52 may have slots 112 to receive the protrusions 110 on the first carrier 34. As the connector 52 moves to the first position, the slots 112 and protrusions 110 engage thus locking the connector 52 to the first carrier 34. In the second position, the connector 52 may be unlocked with the first carrier 34. As the connector 52 moves from the first position to the second position, the slots 112 and protrusions 110 disengage. In the second position, the connector 52 and the first carrier 34 may rotate independently. The range of movement of the connector 52 may be limited to ensure the connector 52 and the second ring gear 38 remain in the locked position. For example, the axial movement of the connector 52 may be limited in one direction by the first ring gear 32 and in the opposite direction by a protrusion 144 on the inner circumferential surface of the second housing portion 56.

The spring 88 is coupled to the connector 52 and may apply a biasing force on the connector 52. The spring 88 may bias the connector 52 to the second position. The spring 88 may be a torsion spring, a compression or extension spring, or other spring that may provide a biasing force. In the example shown in FIGS. 5 and 6, the spring 88 is a torsion spring. The torsion spring may have one or more coils 146 to store the spring energy. The torsion spring may be coupled to the exterior surface of the transmission housing 50. The coils 146 may be aligned with the second fittings 84 of the second housing portion 56 so that the screw 86 or other coupling mechanism may extend through the coils 146 and second fittings 84 to secure the torsion spring to the second housing portion 56. The torsion spring may abut the protrusion 90 on the exterior surface of the second housing portion 56 to axially support the torsion spring. The torsion spring may also have one or more pins 148 that extend through the apertures 82 of the second housing portion 56 to engage the circumferential groove 142 of the connector 52. The torsion spring may also be resilient to torque forces exerted on the drive train 14 during the operation of the power tool 2.

A pivot lever 150 may be coupled to the spring 88. The pivot lever 150 may be C-shaped and extend partially circumferentially around the exterior surface of the transmission housing 50. The pivot lever 150 may have one or more holes 152 that align with the coils 146 and second fittings 84 to receive the screw 86 or other coupling mechanism to secure the pivot lever 150 to the second housing portion 56. The pivot lever 150 may pivot around the coupling axis 154. The pivot lever 150 may have one or more apertures 156 that may be aligned with the apertures 82 of the second housing portion 56. The pins 148 of the spring 88 may extend through both apertures 82, 156 to engage the circumferential groove 142 of the connector 52. Thus, as the pivot lever 150 pivots around the coupling axis 154, the pivot lever 150 guides the spring 88. In one example, the pivot lever 150 may axially guide the spring 88 to move the connector 52 to the first position. The slot length of the apertures 82 of the second housing portion 56 may restrict the axial movement of the pivot lever 150. The pivot lever 150 may also have a lip 158 to engage a control mechanism 160. The pivot lever 150 may also be resilient to torque forces exerted on the drive train 14 during operation of the power tool 2.

The control mechanism 160 may direct the compression of the spring 88. The control mechanism 160 may direct the compression of the spring 88 via the pivot lever 150. The control mechanism 160 may be coupled to a holder 162. In one example, the control mechanism 160 has an aperture 164 that receives a knob 166 to attach the control mechanism 160 to the holder 162, although other coupling methods may be used. Thus, the control mechanism 160 may axially move with the holder 162. The control mechanism 160 may also have a tab 168 that may engage the lip 158 of the pivot lever 150. The tab 168 may also engage the spring 88 directly. When the control mechanism 160 axially moves in response to movement of the holder 162, the tab 168 may apply an axial force on the lip 158 and pivot the pivot lever 150 to cause the spring 88 to move the connector 52 to the first position. The control mechanism 160 may also extend through the guides 102 of the first ring gear 32. Thus, as the first ring gear 32 rotates in response to a received input torque, the guides 102 rotationally guide the control mechanism 160.

The holder 162 is axially movable within the power tool housing 4. The power tool housing 4, however, may confine the axial movement via a rib 170 (shown in FIG. 2) located within the power tool housing 4. Therefore, when the holder 162 moves a predetermined axial distance in one direction, the holder 162 engages the rib 170 and is prohibited from further axial movement in that direction. The rib 170 may be positioned to enable the holder 162 and thus the control mechanism 160 enough axial movement to move the connector 52 into the first position. The rib 170 may also disable the control mechanism 160 from axially surpassing the pivot lever 150 (see FIG. 19) and, therefore, may prevent the control mechanism 160 from becoming lodged behind the pivot lever 150.

The holder 162 may have an alignment protrusion 172 to align with an alignment groove 174 located within the power tool housing 4. The alignment protrusion 172 and alignment groove 174 confine the holder 162 to axial movement. The holder 162 may also have an aperture 176 extending axially through the holder 162. The aperture 176 may receive a holder bar 178 that extends through the aperture 176. The holder bar 178 may be coupled at the opposite end to the trigger switch 18, such that the holder bar 178 axially moves with the trigger switch 18. A holder spring 180 is located between the holder 162 and the trigger switch 18 to bias the holder 162 away from the trigger switch 18. The holder spring 180 may circumferentially surround the holder bar 178.

The trigger switch 18 is coupled to the motor switch 20 by a trigger spring 182. The trigger spring 182 returns the trigger switch 18 to the resting position when the user releases the trigger switch 18. The trigger spring 182 may circumferentially surround a trigger bar 184 extending from the motor switch 20. The trigger bar 184 may alternatively extend from the trigger switch 18. The trigger bar 184 may direct the actuation of the motor switch 20, such that motor switch 20 is not actuated until the trigger bar 184 is actuated. The trigger bar 184 may be located a predetermined distance from the trigger switch 18 so that initial actuation of the trigger switch 18 does not engage the trigger bar 184 and actuate the motor switch 20. In one example, the trigger bar 184 may be located 5 millimeters from the trigger switch 18, such that the trigger switch 18 may be actuated 5 millimeters before actuating the motor switch 20. Other distances, however, may be used.

Figure 7:
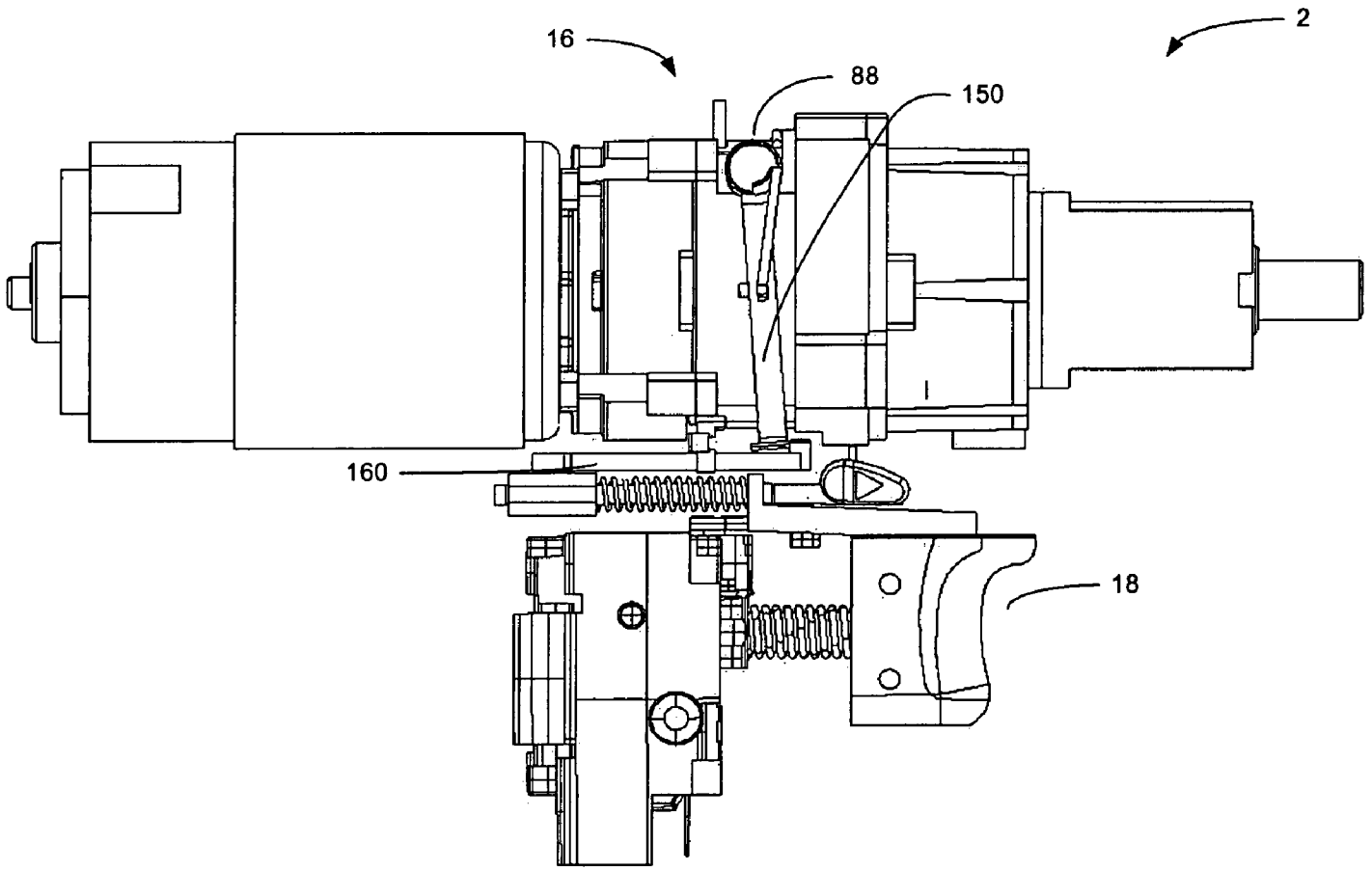
FIG. 7 is an illustration of the transmission in a resting state.
Figure 8:
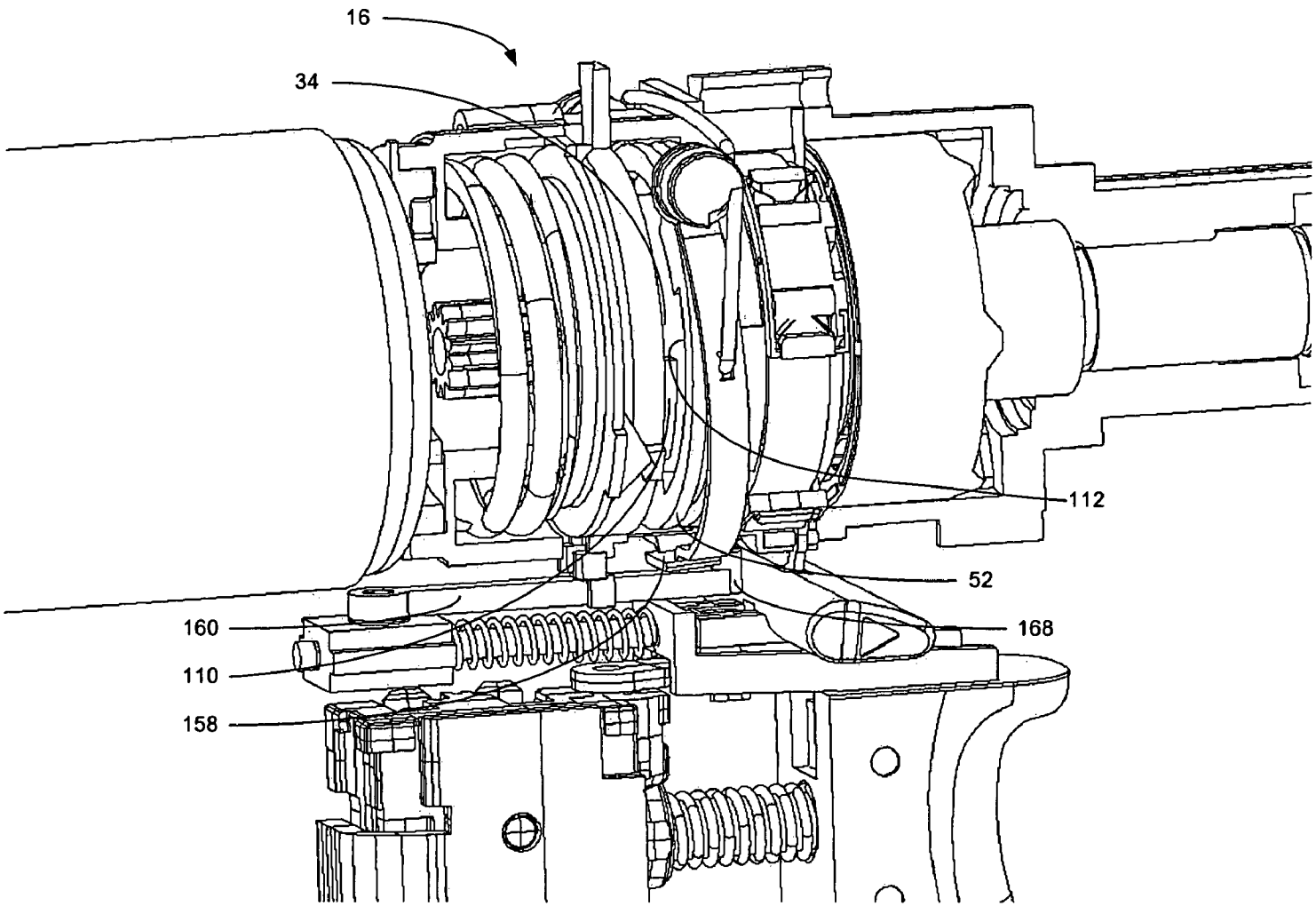
FIG. 8 is a closer view of the transmission of FIG. 7.

The example in FIG. 7 shows a power tool 2 having the variable speed transmission 16 where the transmission is in the resting state, i.e. the trigger switch 18 is not actuated. In the resting state, the control mechanism 160 may not exert an axial force on the pivot lever 150 and thus the spring 88 is free to bias the connector 52 in the second position. FIG. 8 shows an example of the transmission 16 in the resting state where the connector 52 is in the second position. In this position, the slots 112 of the connector 52 are not coupled with the protrusions 110 of the first carrier 34.

Figure 9:
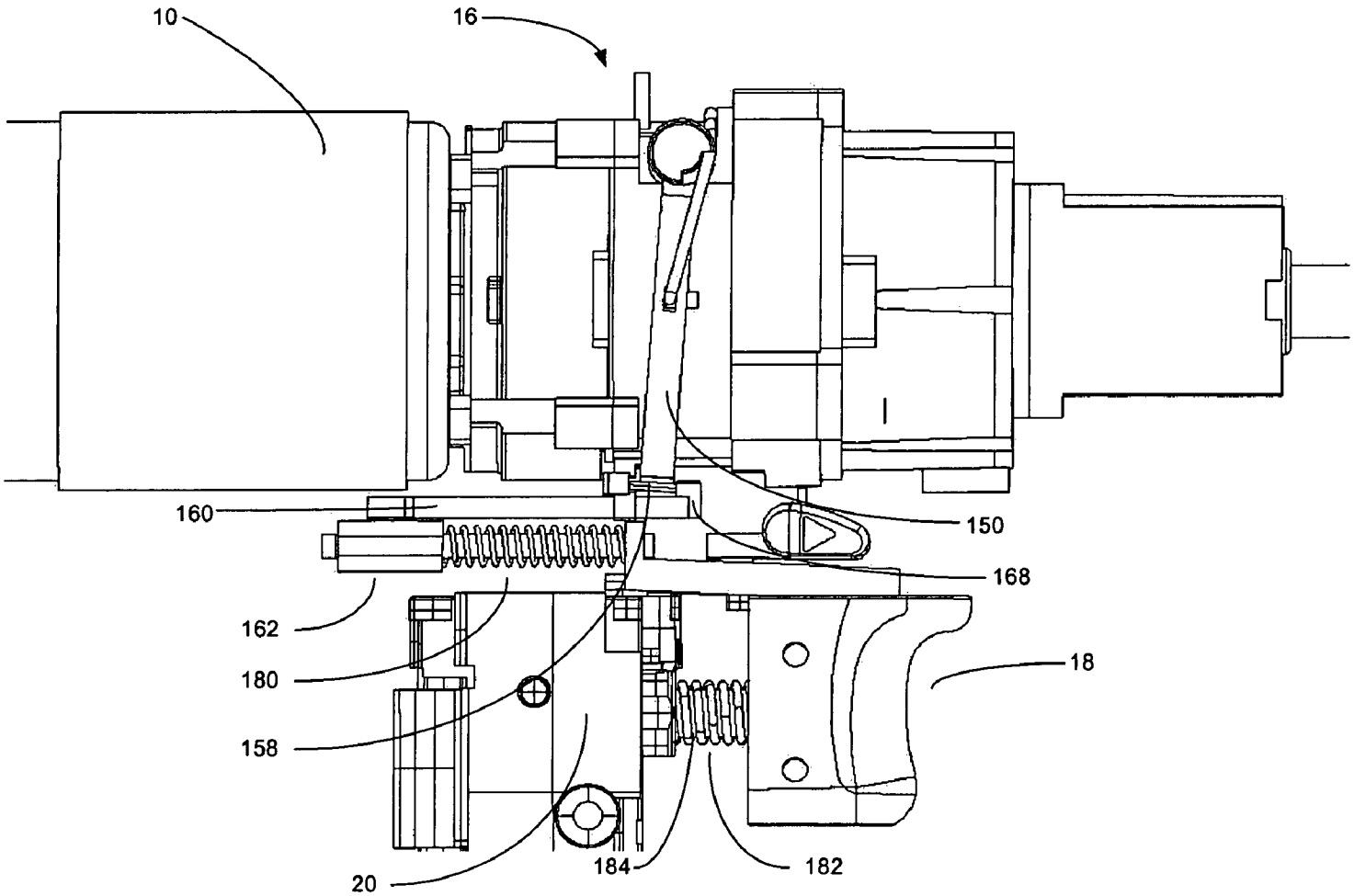
FIG. 9 is an illustration of the transmission after the trigger is partially actuated.
Figure 10:
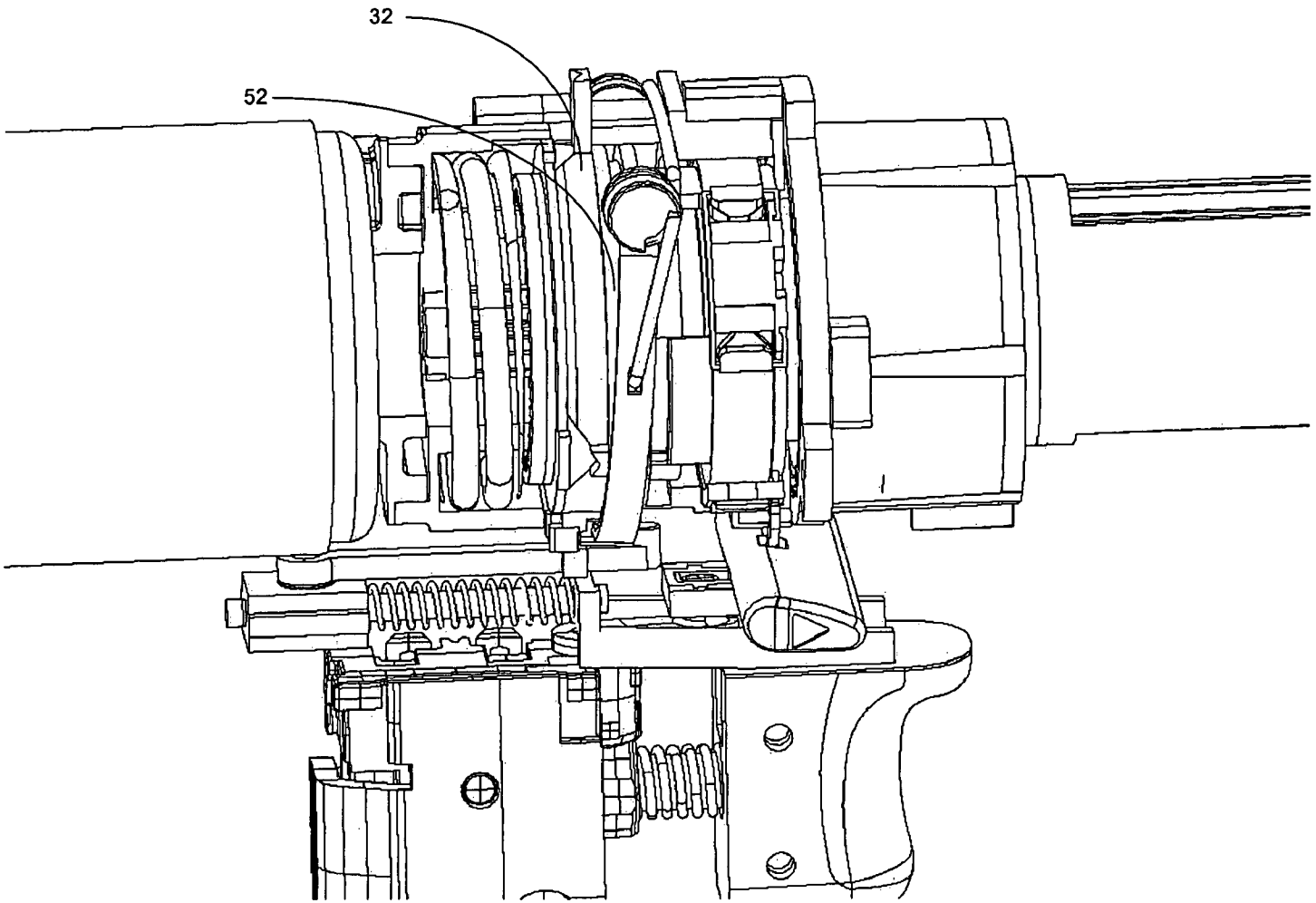
FIG. 10 is an illustration of the transmission after the trigger is partially actuated with portions removed to better illustrate features of the invention.

When the trigger switch 18 is actuated, as shown in FIG. 9, the transmission 16 leaves the resting state. Actuation of the trigger switch 18 may compress the trigger spring 182. The trigger switch 18, however, may not actuate the motor switch 20 until the trigger bar 184 is engaged by the trigger switch 18. The connector 52 may, therefore, be moved to the first position before the motor 10 is activated. The actuated trigger switch 18 may exert an axial force on the holder spring 180 and the holder spring 180 may, in turn, exert an axial force on the holder 162. Because the holder 162 is allowed to axially move within the power tool housing 4, the holder spring 180 axially moves the holder 162. The movement of the holder 162 may move the control mechanism 160 to pivot the pivot lever 150. The pivot lever 150 may compress the spring 88 and the spring 88 may axially move the connector 52 to the first position. The connector 52 is shown in the first position in FIG. 10.

The slots 112 on the connector 52 may have a greater clearance area to increase the likelihood that the protrusions 110 on the first carrier 34 may engage the slots 112 as the connector 52 moves from the second position to the first position (see FIG. 8). The slots 112 and protrusions 110, however, may not be in alignment when the connector 52 changes position. In such a case, the connector 52 cannot fully move to the first position. The control mechanism 160 and holder 162 thus stop short of the rib 170 and the actuation of the trigger switch 18 compresses the holder spring 180 against the holder 162. As the trigger switch 18 continues to be actuated, the trigger switch 18 engages the trigger bar 184 and actuates the motor switch 20. The motor 10 may, therefore, begin to rotate the input pinion 24 which, in turn, rotates the first carrier 34. As the first carrier 34 rotates, the slots 112 may become aligned with the protrusions 110 and thus, the energy stored within the compressed holder spring 180 may be released and the connector 52 may be forced to the first position. Upon movement of the connector 52 to the first position, the holder spring 180 may also force the holder 162 against the rib 170 of the power tool housing 4.

Thus, in the case where the slots 112 and protrusions 110 are aligned, the connector 52 may move to the first position when the trigger switch 18 is actuated. In the case where the slots 112 and protrusions 110 are not aligned, the activation of the motor 10 may rotate the first carrier 34 such that the slots 112 and protrusions 110 may become aligned and the compressed holder spring 180 may force the connector 52 to the first position. Either way, the connector 52 is in the first position when the power tool 2 is activated.

Figure 11:
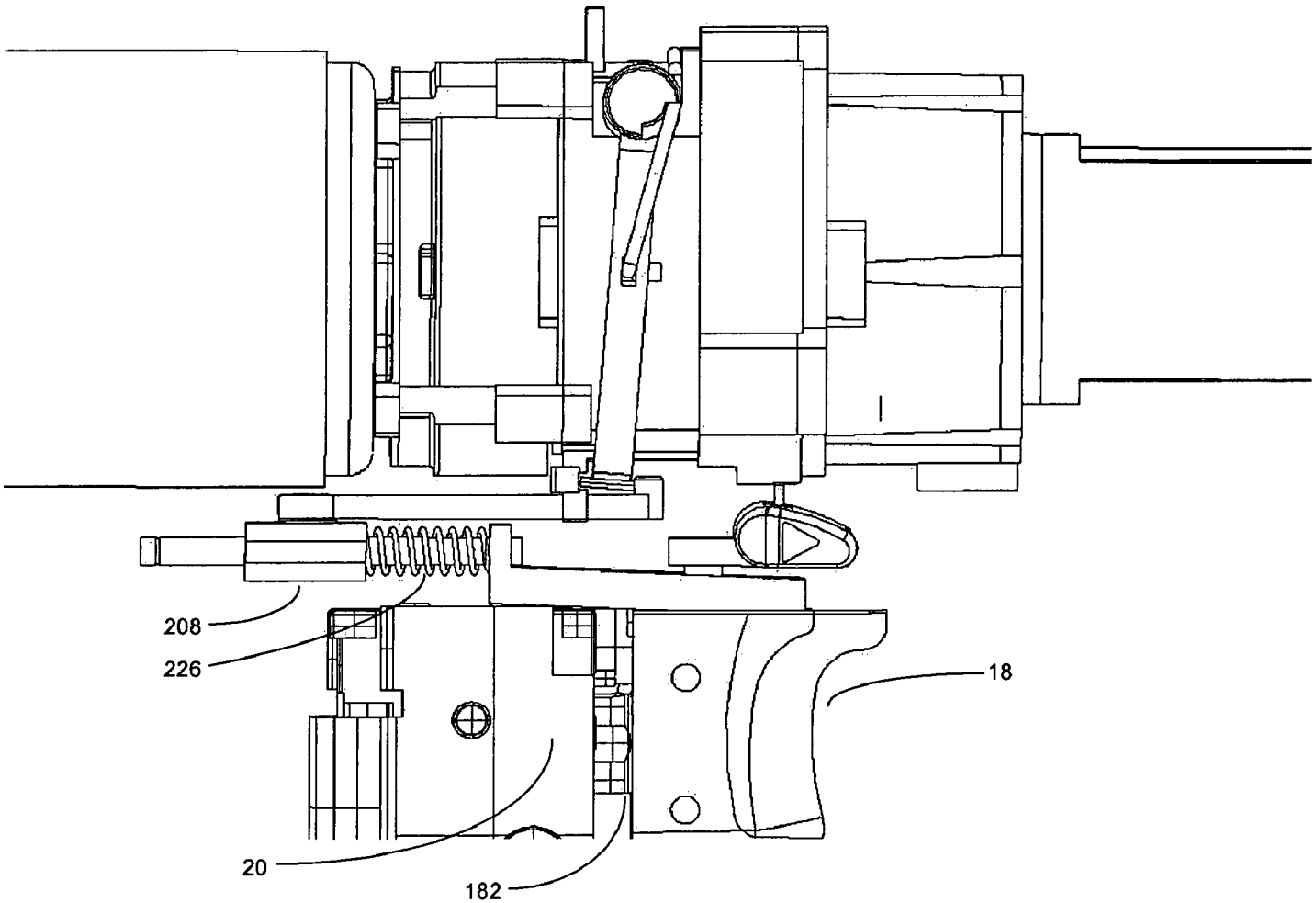
FIG. 11 is an illustration of the transmission after the trigger is fully actuated.
Figure 12:
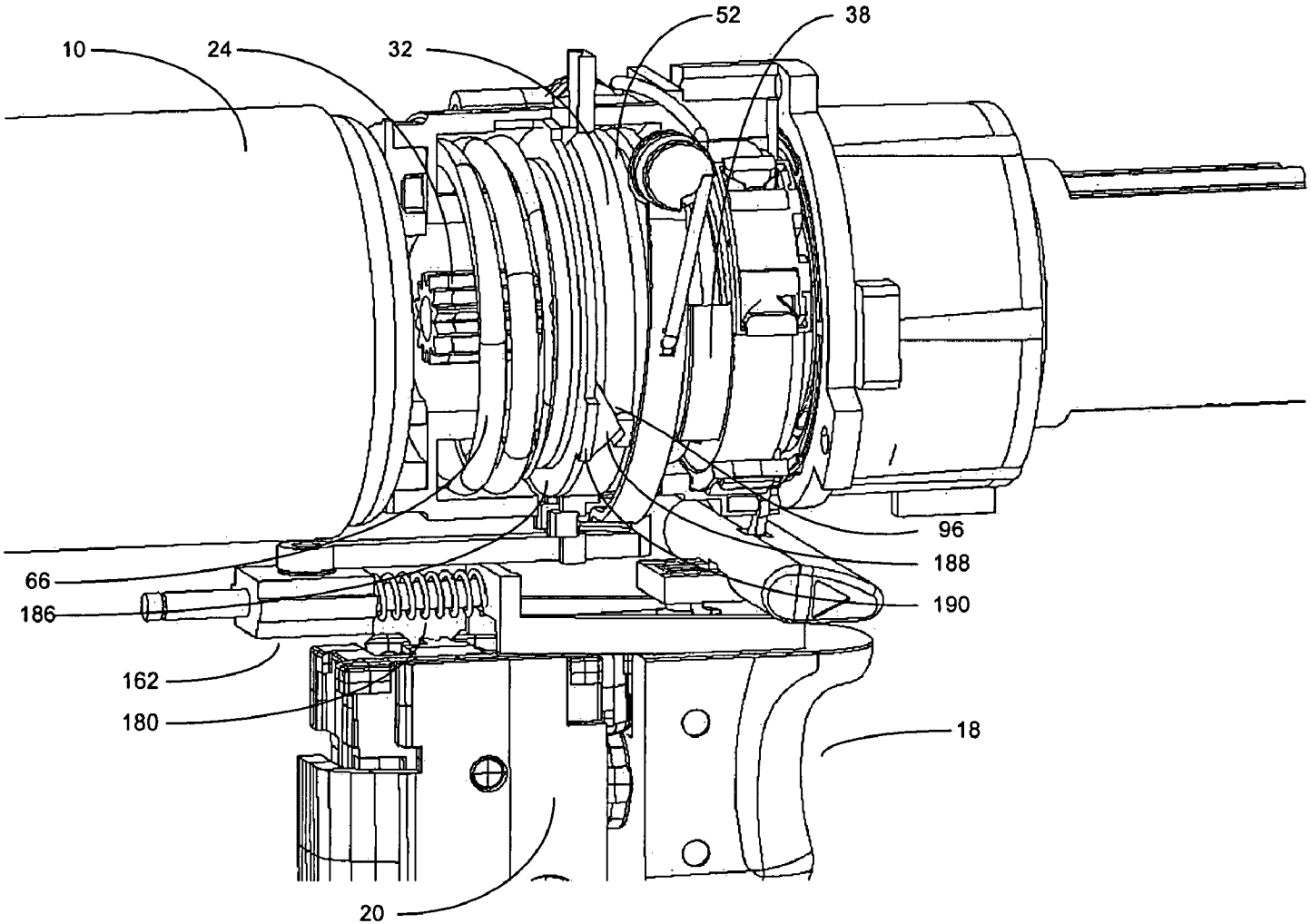
FIG. 12 is an illustration of the transmission after the trigger is fully actuated with portions removed to better illustrate features of the invention.

As shown in FIGS. 11 and 12, the trigger switch 18 is fully actuated and the trigger spring 182 is fully compressed. The holder spring 180 is also compressed against the holder 162 abutting the rib 170 of the tool housing 4 (not shown). The motor 10 rotates the input pinion 24 which, in turn, rotates the first planetary gears 36. The first planetary gears 36 rotate against the first ring gear 32 and cause the first carrier 34 to rotate. The input pinion 24, first planetary gears 36, and first carrier 34 may rotate at different speeds.

In the first position, the connector 52 is locked with the first carrier 34 and thus the connector 52 rotates with the first carrier 34. The connector 52 is also coupled with the second ring gear 38 and thus the first carrier 34 and the second ring gear 38 rotate together at the same speed. The locking of the first carrier 34 and the second ring gear 38 also locks the second planetary gears 42 which, in turn, locks the second carrier 40 to rotate with the first carrier 34 at the same speed. Thus, when the connector 52 is in the first position, the first carrier 34 and the second transmission portion 28 rotate together to produce a first transmission output.

The output of the second transmission portion 28 (sun gear 128) rotates the third planetary gears 48 which, in turn, rotates the third carrier 46. The third carrier 46 rotates the output spindle 22. Because the output of the second transmission portion 28 is the same as the output of the first transmission portion 26, the transmission 50 produces a high speed, low torque output. The high speed, low torque output is provided during the initial stages of the task performed by the power tool 2.

As the operation of the task performed by the power tool 2 advances to the final stages, an increased amount of torque is generally required to complete the task. As the torque increases, the first ring gear 32 may begin to rotate within the transmission housing 50. The amount of torque required to rotate the first ring gear 32 may be predetermined by the torque spring 66. The torque spring 66 exerts an axial force against the first ring gear 32. A torque washer 186 may be coupled between the torque spring 66 and the first ring gear 32. The torque washer 186 is an annular member that may have one or more cam members 188 to engage the cam surfaces 96 of the first ring gear 32. In one example, the cam members 188 form a V-shape to match the cam surfaces 96. In another example, the cam members 188 may be curved to match curved cam surfaces.

The torque washer 186 may axially move within the transmission housing 50. The torque washer 186 may rest on the ledge 94 on the outer circumferential surface of the first ring gear 32. The ledge 94 may act as an axial guide to the torque washer 186 as the torque washer 186 axially moves. The torque washer 186 may also have one or more protrusions 190 extending from the outer circumferential surface. The protrusions 190 may engage the first gap 72 and the notches 70 of the second housing portion 56 to limit the rotation of the torque washer 186 and ensure the cam members 188 remain in engagement with the cam surfaces 96.

Figure 13:
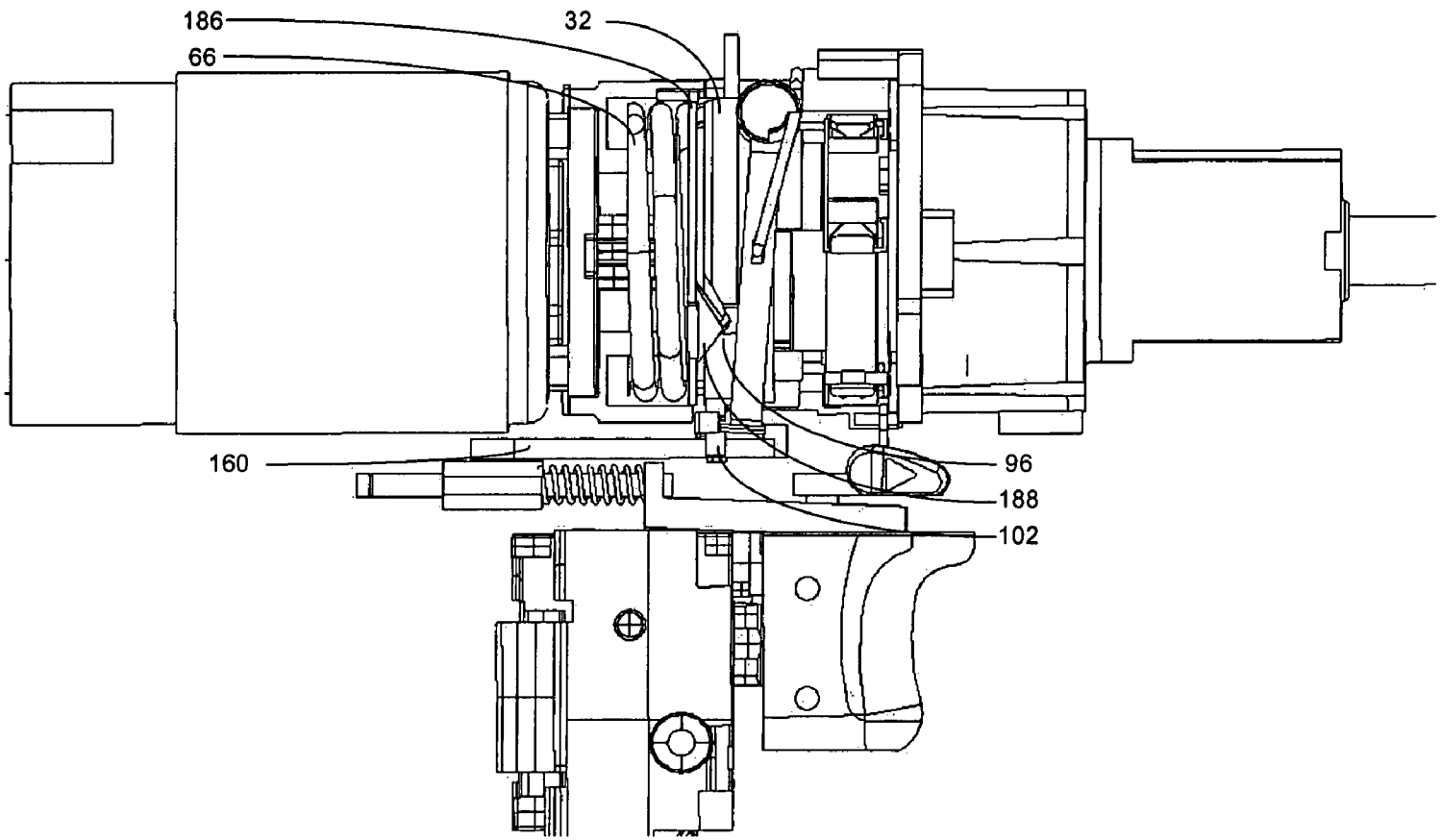
FIG. 13 is an illustration of the transmission responding to an increase in torque with portions removed to better illustrate features of the invention.
Figure 14:
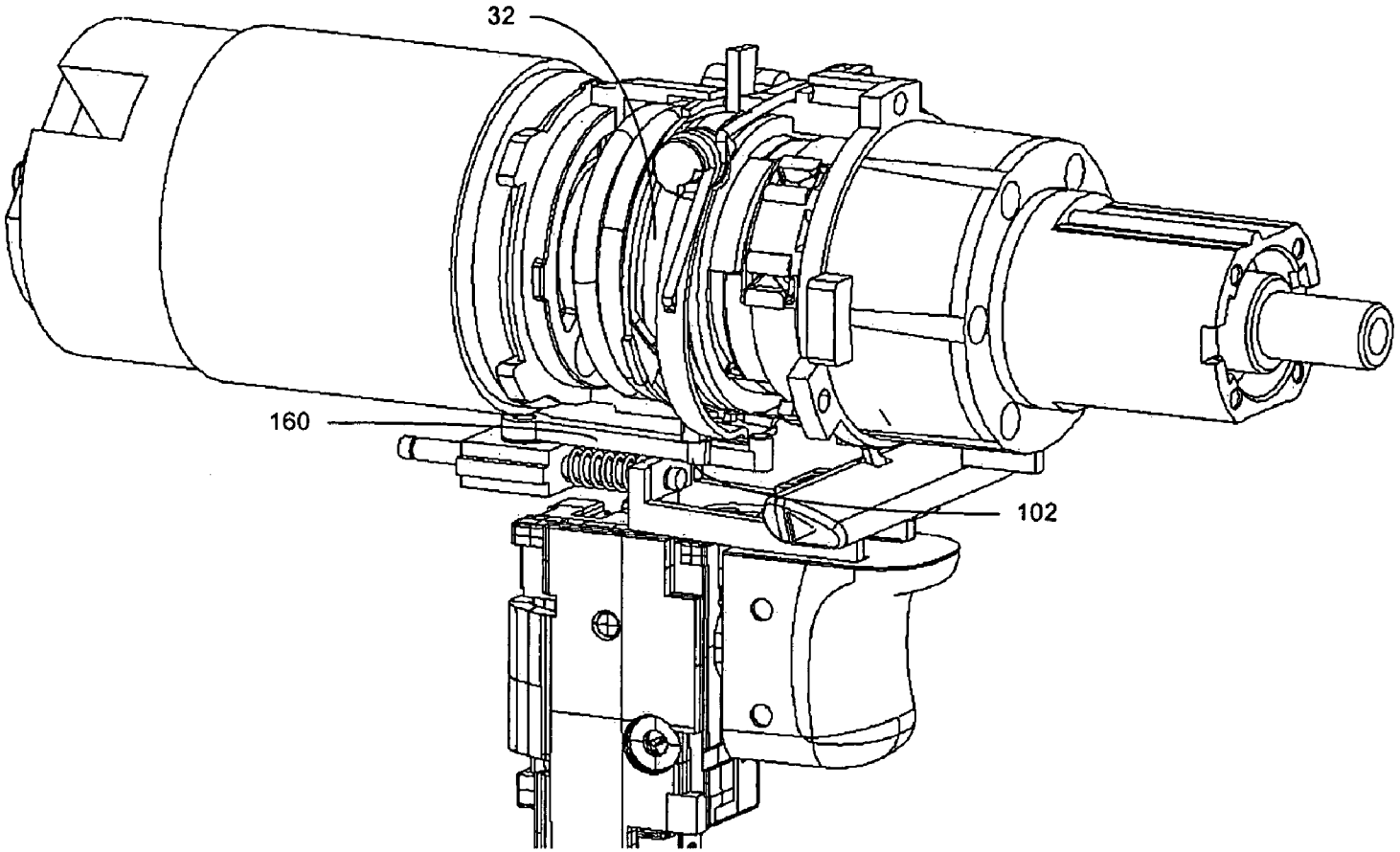
FIG. 14 is an illustration of the transmission responding to an increase in torque with portions removed to better illustrate features of the invention.
Figure 15:
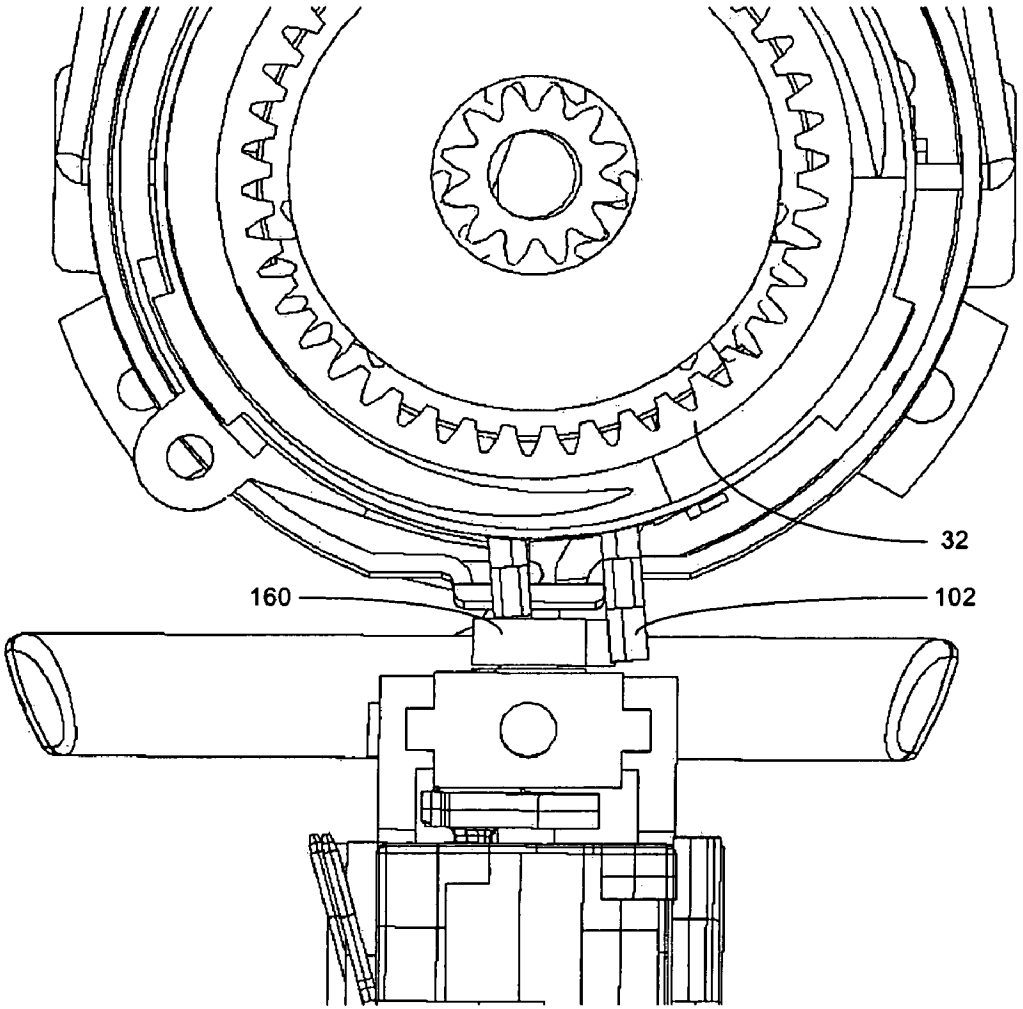
FIG. 15 is an illustration of an exemplary first ring gear rotating in response to an increase in torque.
Figure 16:
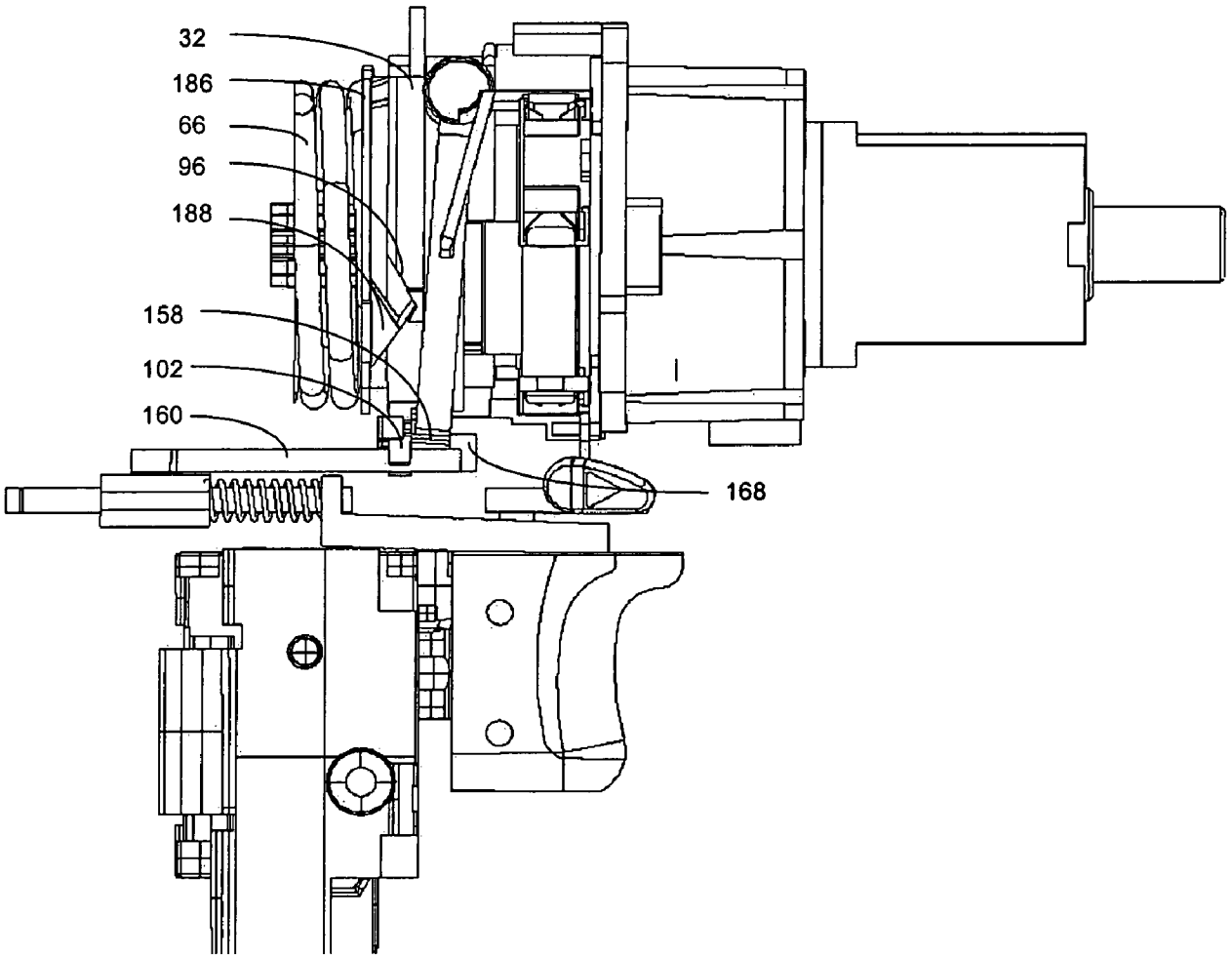
FIG. 16 is an illustration of an exemplary first ring gear rotating in response to an increase in torque.
Figure 17:
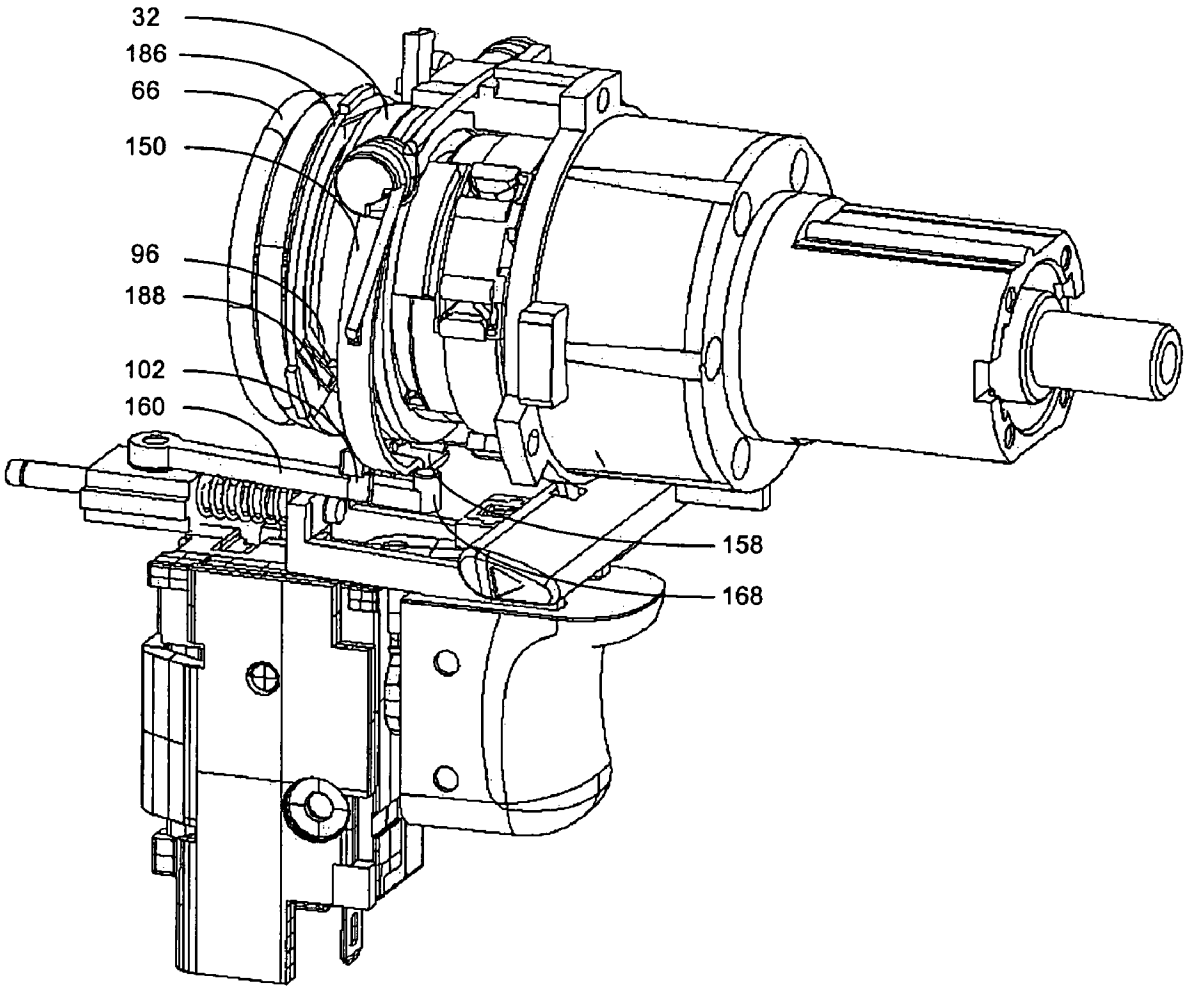
FIG. 17 is an illustration of an exemplary first ring gear rotating in response to an increase in torque with portions removed to better illustrate features of the invention.
Figure 18:
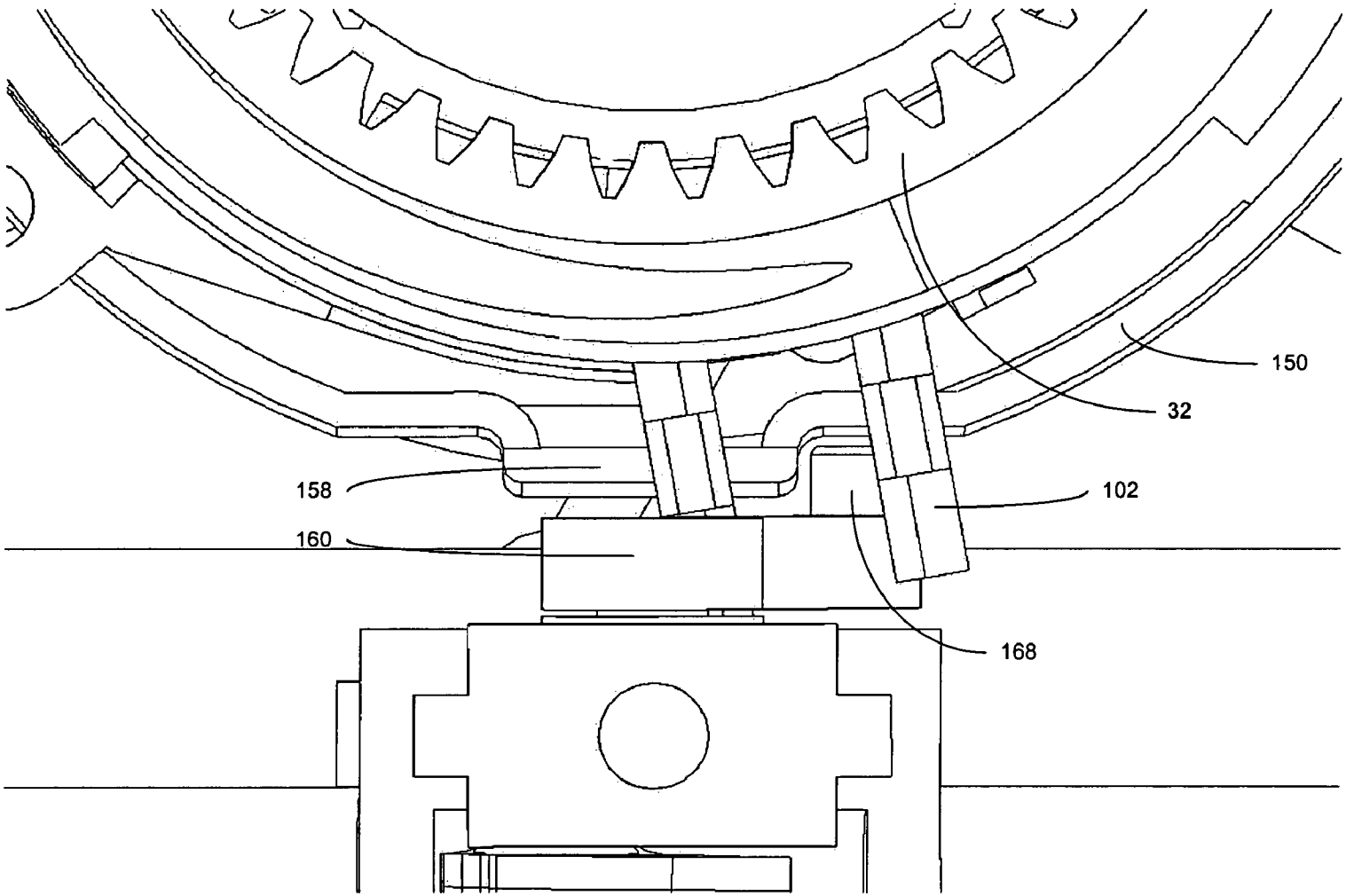
FIG. 18 is a close up illustration of an exemplary first ring gear rotating in response to an increase in torque.

As increased torque is required, the first ring gear 32 may begin to rotate, as shown in FIG. 13. The slope of the cam surfaces 96 force the cam members 188 outwards and thus the first ring gear 32 axially forces the torque washer 186 into the force of the torque spring 66. As the first ring gear 32 rotates, the guides 102 may guide the control mechanism 160 to rotate, as shown in FIGS. 14 and 15. When the received torque equals the force of the torque spring 66, the cam members 188 are forced to the outer edges of the cam surfaces 96, as shown in FIG. 16. At this degree of rotation, the tab 168 of the control mechanism 160 rotates past the lip 158 of the pivot lever 150 as shown in FIG. 17. The control mechanism 160 disengages the pivot lever 150 as shown in FIG. 18.

Figure 19:
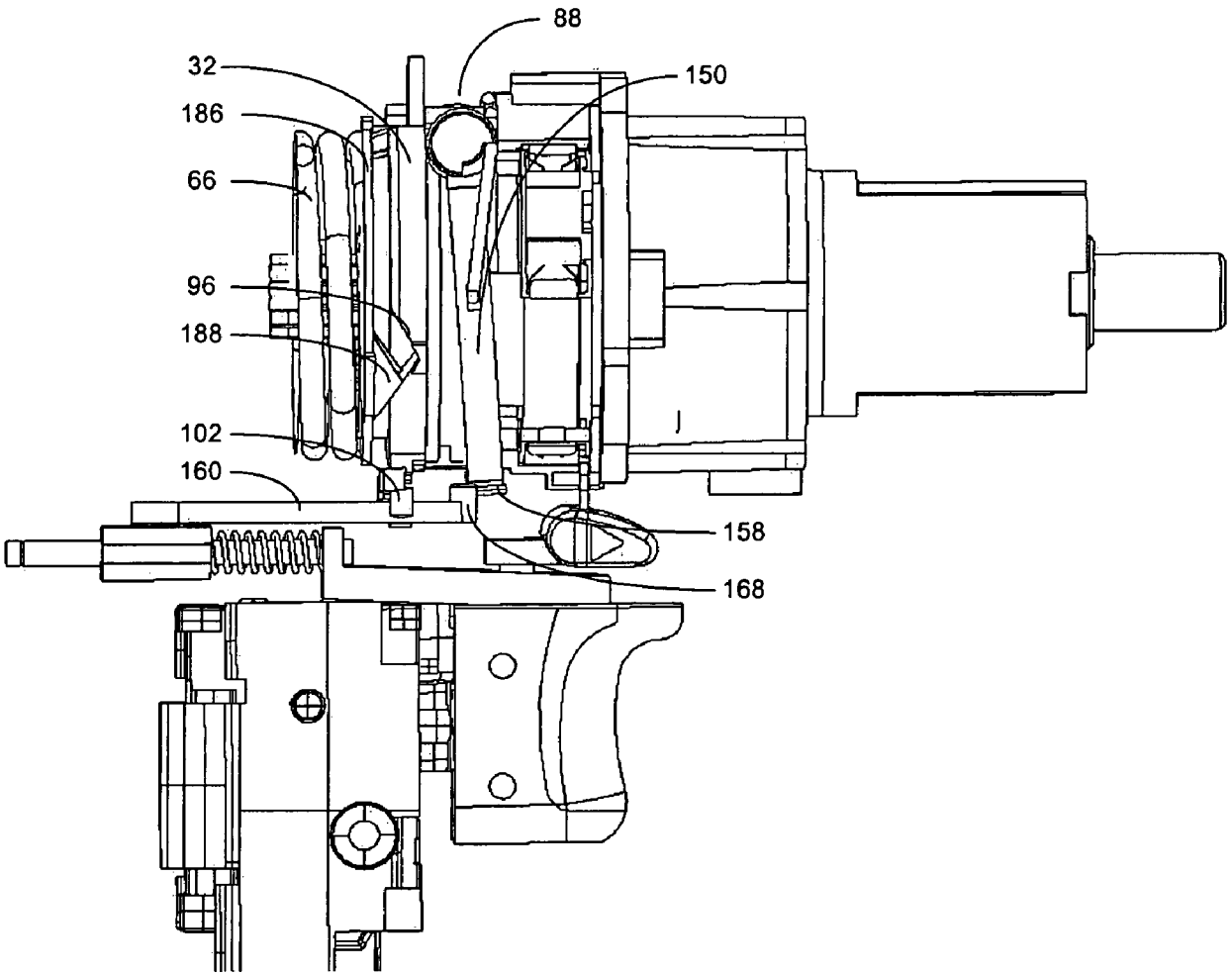
FIG. 19 is an illustration of the transmission changing speeds.
Figure 20:
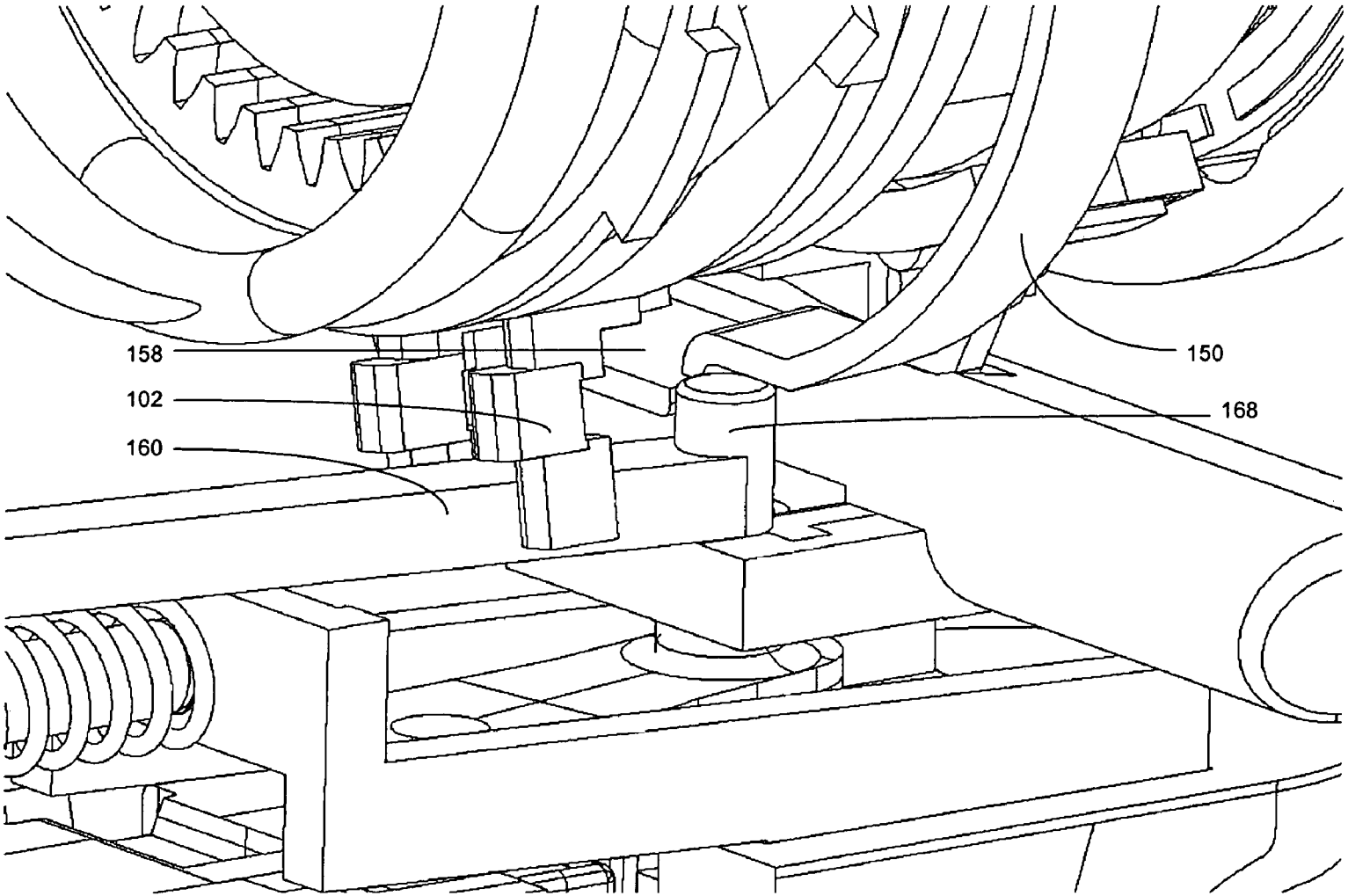
FIG. 20 is a close up illustration of the transmission changing speeds.

When the control mechanism 160 disengages the pivot lever 150, the spring 88 releases the stored energy and may force the connector 52 to the second position, as shown in FIGS. 19 and 20. In the second position, the slots 112 of the connector 52 disengage the protrusions 110 of the first carrier 34 and the connector 52 is unlocked with the first carrier 34 (see for example FIG. 8 where the connector 52 is in the second position). Thus, the first carrier 34 and the connector 52 may rotate independently. Because the connector 52 is coupled with the second ring gear 38, the first carrier 34 may also rotate independently of the second ring gear 38.

Once the connector 52 and therefore the second ring gear 38 unlocks with the first carrier 34, the first carrier 34 via the sun gear 106 rotates the second planetary gears 42 which, in turn, forces the second ring gear 38 to rotate in the opposite direction that the second ring gear 38 was rotating when the second ring gear 38 was locked to the first carrier 34. A one-way clutch 78, however, prohibits the second ring gear 38 from rotating in the opposite direction. The second ring gear 38 is locked by the one-way clutch 78. The sun gear 106 of the first carrier 34 rotates the second planetary gears 42 against the second ring gear 38 which, in turn, rotates the second carrier 40. The second carrier 40 therefore rotates independently of the first carrier 34. Thus, when the connector 52 is in the second position, the first transmission portion 26 and the second transmission portion 28 rotate independently to produce a second transmission output.

The output of the second transmission portion 28 (sun gear 128) rotates the third planetary gears 48 which, in turn, rotates the third carrier 46. The third carrier 46 rotates the output spindle 22. Because the first transmission portion 26 and the second transmission portion 28 rotate independently, the transmission 50 produces a low speed, high torque output. The low speed, high torque output is provided during the final stages of the task performed by the power tool 2.

Figure 21:
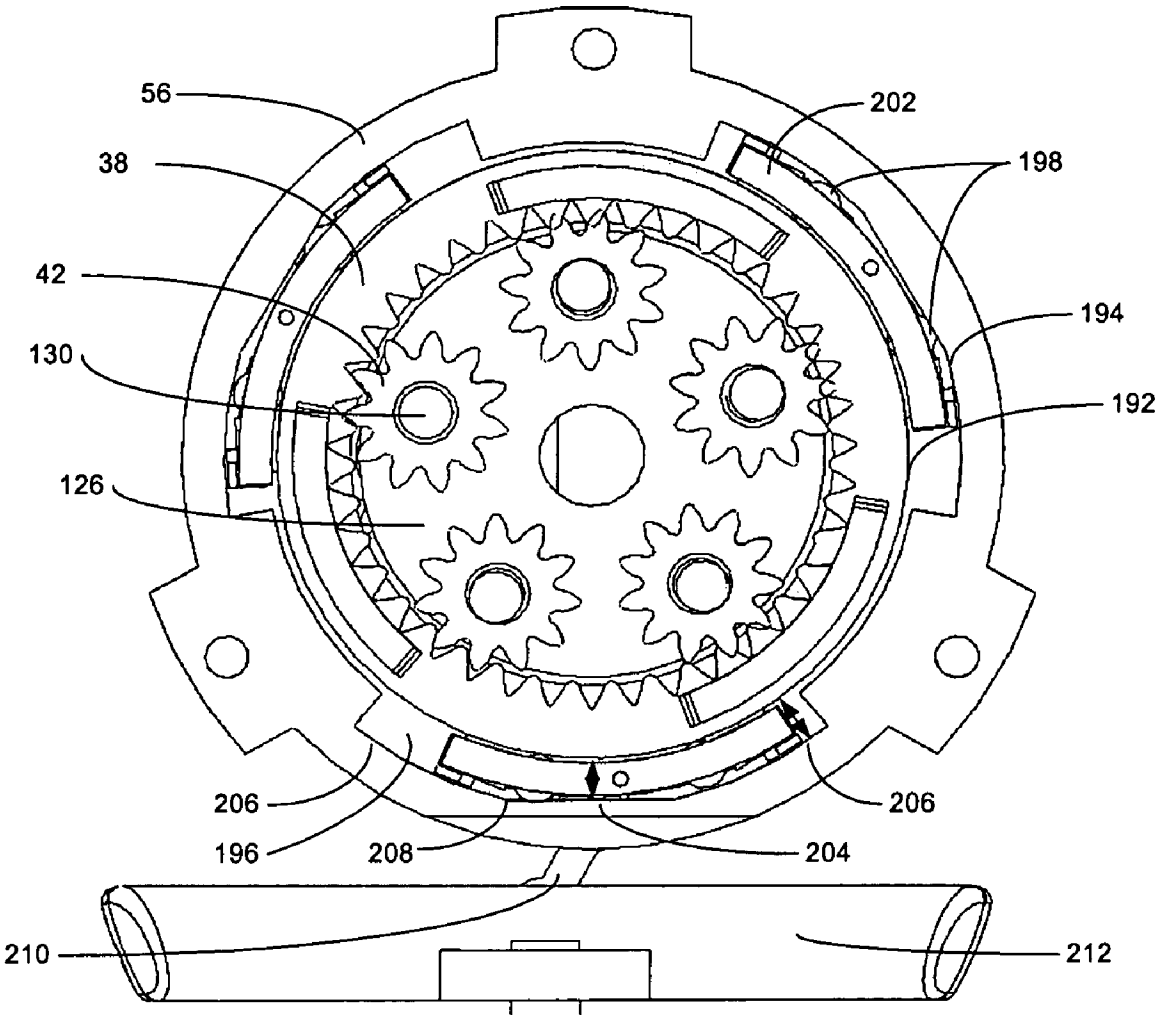
FIG. 21 is an illustration of an exemplary one-way clutch set in the forward position.
Figure 22:
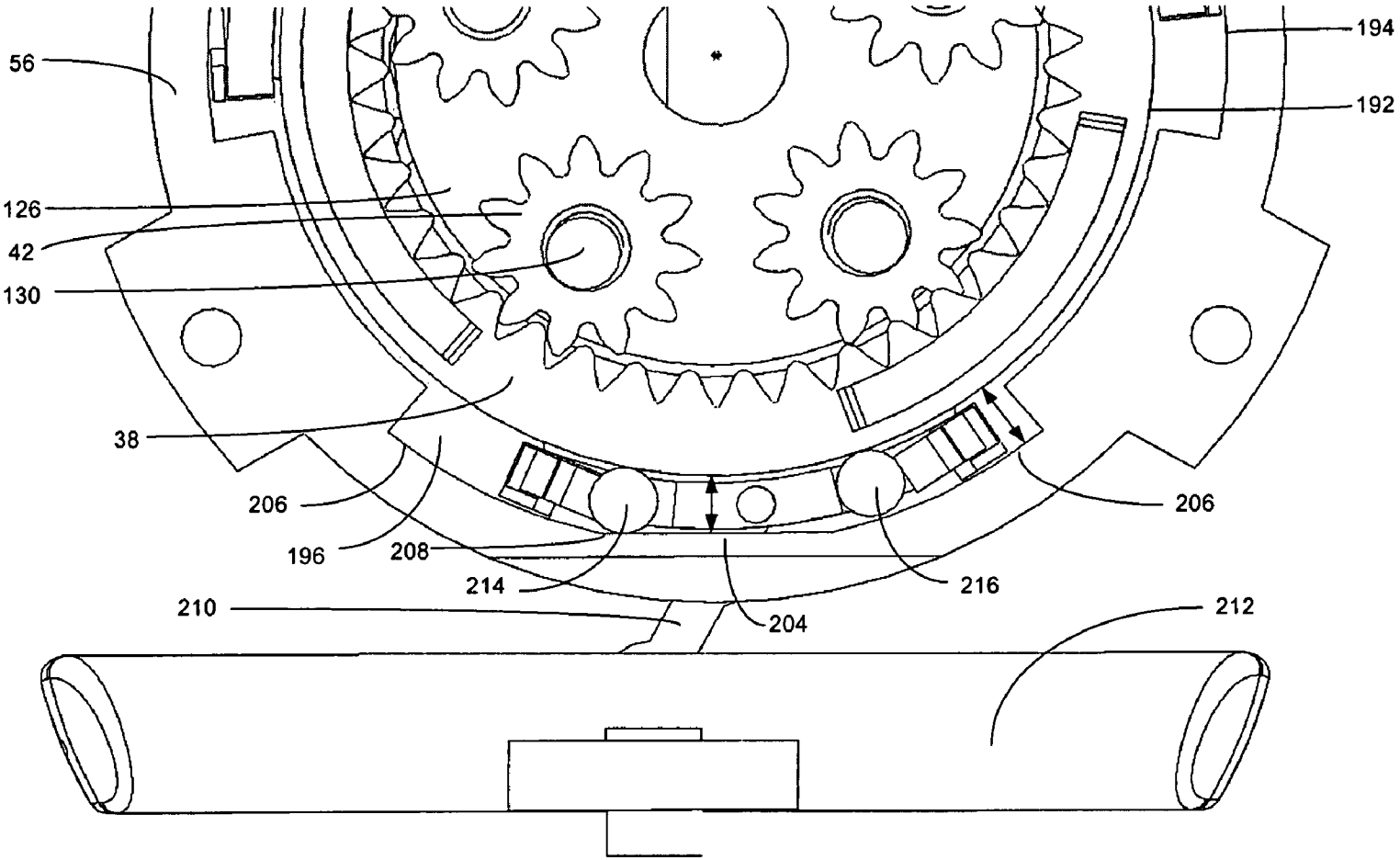
FIG. 22 is a close up illustration of the exemplary one-way clutch set of FIG. 21.

An example of the one-way clutch 78 is shown in FIGS. 21 and 22. The one-way clutch 78 allows the second ring gear 38 to rotate in one direction and prohibits the second ring gear 38 from rotating in the opposite direction. The one-way clutch 78 has an inner race 192 defined by the outer circumferential surface of the second ring gear 38 and an outer race 194 defined by the grooves 76 formed within the inner circumferential surface of the second housing portion 56. The inner race 192 and outer race 194 form one or more compartments 196. The one-way clutch 78 has one or more lock pins 198 that are received in the compartments 196. The lock pins 198 are coupled to a clutch washer 200 (shown in FIGS. 5 and 6) by lock pin holders 202.

The compartments 196 have a lock portion 204 and a release portion 206. The lock portion 204 is formed by an inclined surface 208 on the outer race 194. The inclined surface 208 creates a smaller distance between the inner race 192 and the outer race 194 than the diameter of the lock pins 198 to prohibit the lock pins 198 from rotating. The release portion 206 has a distance between the inner race 192 and the outer race 194 that is greater than the diameter of the lock pins 198 to permit the lock pins 198 to freely rotate. As shown in the example in FIG. 22, the lock portion 204 is centered within the compartments 196 and located between two release portions 206.

The clutch washer 200 is coupled to a clutch lever 210. The clutch lever 210 rotates the clutch washer 200 depending on the direction of pivot of the clutch lever 210. The clutch lever 210 is directed by a forward/reverse button 212. The forward/reverse button 212 is coupled to the motor 10 to determine the rotating direction of the motor 10. When the forward/reverse button 212 is set to the forward output (motor 10 rotates the input pinion 24 in a clockwise direction), the forward/reverse button 212 directs the clutch lever 210 to rotate the clutch washer 200 in the counter-clockwise direction. In this position, the one-way clutch 78 permits the second ring gear 38 to rotate in the clockwise direction and prohibits the second ring gear 38 from rotating in the opposite direction. Alternatively, when the forward/reverse button 212 is set to the reverse output (motor 10 rotates the input pinion 24 in the counter-clockwise direction), the forward/reverse button 212 directs the clutch lever 210 to rotate the clutch washer 200 in the clockwise direction. In this position, the one-way clutch 78 permits the second ring gear 38 to rotate in the counter-clockwise direction and prohibits the second ring gear 38 from rotating in the opposite direction.

In the examples in FIGS. 21 and 22, the forward/reverse button 212 is set to the forward output and the clutch washer 200 is rotated in the counter-clockwise direction. As shown in FIG. 22, the clutch washer 200 moves a first lock pin 214 to the lock portion 204 of the compartment 196 and moves a second lock pin 216 to the release portion 206 of the compartment 196. Thus, rotation of the second ring gear 38 in the counter-clockwise direction is prohibited because the rotation will force the first lock pin 214 into the lock portion 204 where the first lock pin 214 is prohibited from rotating. The friction against the first lock pin 214 and the second ring gear 38 prohibits the second ring gear 38 from rotating in the counter-clockwise direction. The second ring gear 38 may, however, rotate in the clockwise direction because the force of the rotation will force the first lock pin 214 out of the lock portion 204 where the first lock pin 214 may freely rotate. The second lock pin 216 remains in the release portion 206 due to the setting of the clutch lever 210 and also may freely rotate. Thus, the second ring gear 38 may rotate in the clockwise direction when the forward/reverse button 212 is set to the forward output. The one-way clutch 78 works in a similar manner when the forward/reverse button 212 is set to the reverse output.

Therefore, as the transmission 16 outputs in high speed, low torque, the second ring gear 38 rotates with the first carrier 34 and in the same direction as the input pinion 24. The one-way clutch 78 allows the second ring gear 38 to rotate in this direction. As the torque increases, however, the second ring gear 38 unlocks with the first carrier 34 via the connector 52 and the transmission 16 outputs in the low speed, high torque. When the transmission 16 changes speeds, the second ring gear 38 is forced to rotate in an opposite direction as the input pinion 24. The one-way clutch 78 prohibits the second ring gear 38 from rotating in this direction and locks the second ring gear 38.

When the input torque decreases, such as when the trigger switch 18 is de-actuated or when the load on the power tool 2 is removed, the torque spring 66 overcomes the received input torque on the first ring gear 32. The torque spring 66, therefore, forces the cam members 188 of the torque washer 186 into the cam surfaces 96 of the first ring gear 32 to return the first ring gear 32 to its resting position. The guides 102 accordingly guide the control mechanism 160 to engage the lip 158 of the pivot lever 150. Because the spring 88 is biasing the connector 52 to the second position, the pivot lever 150 prohibits the control mechanism 160 from fully reaching the resting position and therefore prohibits the first ring gear 32 from fully rotating to the resting position.

When the trigger switch 18 is released, the trigger spring 182 forces the trigger switch 18 to its resting position and the trigger bar 184 is disengaged thus deactivating the motor 10. The release of the trigger switch 18 also releases the holder spring 180 and the holder 162 may axially move away from the rib 170 of the power tool housing 2. The control mechanism 160 axially moves with the holder 162 along the lip 158 of the pivot lever 150 until the control mechanism 160 axially surpasses the pivot lever 150, at which point the first ring gear 32 may fully rotate to the resting position. The guides 102 therefore may fully guide the control mechanism 160 to the resting position, where control mechanism 160 awaits actuation of the trigger switch 18 to once again pivot the pivot lever 150 and cause the spring 88 to axially move the connector 52 to the first position.

The above description may be applicable to the variable speed transmission 16 in both the forward and reverse motor 10 settings; however, the rotation of several of the components may be reversed. Moreover, while various embodiments of the invention have been described, it will be apparent to those of ordinary skill in the art that many more embodiments and implementations are possible within the scope of the invention. Accordingly, the invention is not to be restricted except in light of the attached claims and their equivalents.

The invention claimed is:

1. A transmission for a power tool that automatically switches from a first transmission output to a second transmission output in response to a received predetermined input torque, the transmission comprising:

a first transmission portion having a first ring gear operable to receive an input torque;

a second transmission portion coupled to the first transmission portion and having a second ring gear;

an annular connector coupled to the second ring gear and axially movable between a first position to produce a first transmission output and a second position to produce a second transmission output; and a control mechanism that engages a spring that is coupled to the annular connector and that biases the annular connector to the second position, wherein the annular connector is in the first position when the input torque is less than a predetermined force and is in the second position when the input torque exceeds the predetermined force.

2. The transmission of claim 1 wherein the annular connector comprises at least one slot engaging at least one protrusion on a first carrier when the annular connector is in the first position.

3. The transmission of claim 1 further comprising:

an annular member having at least one cam member engaging a cam surface on the first ring gear; and a torque spring exerting a force on the annular member to oppose rotation of the first ring gear.

4. The transmission of claim 1 further comprising a pivot lever coupled to the spring to move the annular connector to the first position.

5. The transmission of claim 1 further comprising a trigger switch coupled to the control mechanism.

6. The transmission of claim 5 wherein the trigger switch actuates a motor switch and wherein the control mechanism moves the connector to the first position prior to actuation of the motor switch.

7. The transmission of claim 1 wherein at a predetermined input torque the first ring gear guides the control mechanism to release the spring to move the connector to the second position.

8. The transmission of claim 1 further comprising a one-way clutch operable to lock the second ring gear when the connector is moved to the second position.

9. The transmission of claim 1 further comprising a housing, wherein the spring is coupled to the exterior of the housing and engages a groove on the connector via at least one slot in the housing.

10. A power tool comprising:

a trigger switch operable to selectively power a motor via a motor switch; and a variable speed transmission comprising:

a first transmission portion having a first ring gear operable to receive an input torque;

a second transmission portion coupled to the first transmission portion and having a second ring gear;

an annular connector coupled to the second ring gear and axially movable between a first position to produce a first transmission output and a second position to produce a second transmission output; and a control mechanism that engages a spring coupled to the annular connector, wherein when the trigger switch is actuated, the control mechanism compresses the spring to move the annular connector to the first position and when the received input torque exceeds a predetermined force, the control mechanism releases the spring to move the annular connector to the second position.

11. The power tool of claim 10 wherein the annular connector comprises at least one slot that engages at least one protrusion on a first carrier when the annular connector is in the first position and disengages the at least one protrusion when the annular connector is in the second position.

12. The power tool of claim 10 further comprising:

an annular member having at least one cam member engaging a cam surface on the first ring gear; and a torque spring exerting a force on the annular member such that when the received input torque is less than the force, the force opposes rotation of the first ring gear and when the received input torque exceeds the force, the first ring gear drives the cam surface against the at least one cam member to move the annular member.

13. The power tool of claim 10 further comprising a pivot lever coupled to the spring to move the annular connector to the first position.

14. The power tool of claim 10 wherein the connector is moved to the first position prior to the trigger switch actuating the motor switch.

15. The transmission of claim 10 wherein at a predetermined torque input the first ring gear guides the control mechanism to release the spring to move the connector to the second position.

16. An automatic transmission for a power tool comprising:

a first transmission portion operable to receive an input torque and having a first carrier;

a second transmission portion coupled to the first transmission portion;

an annular connector movable between a first position when the received input torque is less than a predetermined force and a second position when the received input torque is greater than the predetermined force; wherein when the annular connector is in the first position, the first carrier and the second transmission portion rotate together to produce a first transmission output, and wherein when the annular connector is in the second position, the first transmission portion and the second transmission portion rotate independently to produce a second transmission output.

17. The transmission of claim 16 further comprising a control mechanism compressing the spring when a trigger switch is actuated and releasing the spring in response to a received input torque greater than the predetermined force.

18. The transmission of claim 16 further comprising a torque spring exerting a force on a first ring gear of the first transmission portion to oppose rotation of the first ring gear, wherein when the received input torque exceeds the predetermined force, the first ring gear rotates against the force and releases the spring to move the connector to the second position.

19. The transmission of claim 16 wherein the first carrier and the second transmission portion rotate together via at least one slot on the annular connector engaging at least one protrusion on the first carrier.

20. The transmission of claim 16 further comprising a trigger switch selectively activating a motor and wherein the annular connector moves from the second position to the first position prior to actuation of the motor.

* * * * *